US008245850B2

(12) United States Patent
Mainwaring et al.

(10) Patent No.: US 8,245,850 B2
(45) Date of Patent: Aug. 21, 2012

(54) SCREEN SEPARATORS

(75) Inventors: Nigel John Mainwaring, Surrey (GB); Everard James Walton, Tyne and Wear (GB)

(73) Assignee: Russell Finex Limited, Middlesex (GB)

( * ) Notice: Subject to any disclaimer, the term of this patent is extended or adjusted under 35 U.S.C. 154(b) by 421 days.

(21) Appl. No.: 12/391,380

(22) Filed: Feb. 24, 2009

(65) Prior Publication Data

US 2009/0159507 A1 Jun. 25, 2009

Related U.S. Application Data

(63) Continuation-in-part of application No. 10/579,129, filed as application No. PCT/GB2004/004813 on Nov. 12, 2004, now Pat. No. 7,721,896.

(30) Foreign Application Priority Data

Nov. 13, 2003 (GB) ..... 0326514.7

(51) Int. Cl.
*B07B 1/49* (2006.01)

(52) U.S. Cl. ..... 209/405; 209/392; 209/404; 209/409; 209/410

(58) Field of Classification Search ..... 209/392, 209/404, 405, 409, 410, 411
See application file for complete search history.

(56) References Cited

U.S. PATENT DOCUMENTS

| | | | | |
|---|---|---|---|---|
| 3,422,955 | A | 1/1969 | Mock et al. | 209/315 |
| 4,082,657 | A | 4/1978 | Gage | 209/311 |
| 4,582,597 | A * | 4/1986 | Huber | 209/313 |
| 4,755,287 | A | 7/1988 | Jones | 209/355 |
| 4,816,153 | A | 3/1989 | Ando et al. | |
| 4,846,352 | A | 7/1989 | Bailey | 209/399 |
| 5,226,546 | A | 7/1993 | Janssens et al. | 209/319 |
| 6,096,210 | A * | 8/2000 | Hazrati et al. | 210/388 |
| 6,935,511 | B2 * | 8/2005 | Seyffert et al. | 209/404 |
| 6,938,779 | B2 | 9/2005 | Burnett | 209/405 |
| 7,216,768 | B2 * | 5/2007 | Fisher et al. | 209/395 |
| 2003/0057140 | A1 | 3/2003 | Hukki et al. | 209/405 |
| 2004/0074819 | A1 * | 4/2004 | Burnett | 209/405 |
| 2004/0140249 | A1 * | 7/2004 | Schulte et al. | 209/268 |
| 2006/0180509 | A1 * | 8/2006 | Burnett et al. | 209/405 |
| 2009/0159507 | A1 | 6/2009 | Mainwaring et al. | |

FOREIGN PATENT DOCUMENTS

DE 202 11 833 U1 12/2002

(Continued)

OTHER PUBLICATIONS

Office Action from parent U.S. Appl. No. 10/579,129, dated Aug. 4, 2008.

(Continued)

*Primary Examiner* — Terrell Matthews
(74) *Attorney, Agent, or Firm* — Westman, Champlin & Kelly, P.A.

(57) ABSTRACT

Apparatus is provided, in or for a screen separator for sieving materials, for clamping one or more sieve screen frames 78 within the confines of a chassis 40 of the separator to prevent egress of material from the separator. The apparatus comprises a sheath 50 extending around and embracing the chassis 40 and one or more expandable elements 66 for urging the sheath 50 against the chassis 40 and the screen frame(s) 78 to impart uniform clamping pressure to the clamped elements. The sheath 50 is designed to provide ease of mounting and release.

27 Claims, 21 Drawing Sheets

FOREIGN PATENT DOCUMENTS

| | | | |
|---|---|---|---|
| EP | 02 18 315 | | 4/1987 |
| GB | 1 135 402 | | 12/1968 |
| GB | 2 059 807 | A | 4/1981 |
| GB | 21 76 425 | A | 12/1986 |
| GB | 2176424 | A | 12/1986 |
| GB | 23 27 897 | | 2/1999 |
| JP | 2001038293 | A | 2/2001 |
| SU | 839611 | | 6/1981 |
| SU | 1488027 | | 6/1989 |
| WO | WO 97/47404 | | 12/1997 |

OTHER PUBLICATIONS

Final Office Action from parent U.S. Appl. No. 10/579,129, dated Jun. 22, 2009.

"International Search Report" PCT/GB2004/004813.

* cited by examiner

SCREEN SEPARATORS

This is a Continuation-In-Part of application Ser. No. 10/579,129, filed May 12, 2006 now U.S Pat. No. 7,721,896, which is a 371 of and claims priority of International patent application Serial No. PCT/GB2004/004813, filed Nov. 12, 2004, and published in English the contents of which are hereby incorporated by reference in their entirety.

FIELD OF THE INVENTION

This invention is concerned with vibrating sieve separators for use in sieving materials using vibratory screens.

BACKGROUND OF THE INVENTION

Such separators are well-known and generally use one or more taut screens of selected mesh size which are mounted in or on a chassis that is itself supported on a base by elastomeric mounts, springs or other resilient members. The chassis is coupled to a motor which drives offset weights to impart vibration to the chassis and thereby to the screen(s) of the sieve.

Separators are widely used in many industries and the use is determined by the materials to be sieved or separated, and these materials themselves determine the mesh size for the screen.

One industry in which such separators are widely used is the pharmaceutical industry. In this industry, it is of special importance that, when sieving a product, the probability of any sieved material escaping into the surrounding environment is restricted ideally to zero, but in reality to the lowest possible margin, so that neither workers nor other equipment nor products can become contaminated.

There are prior art arrangements to ensure that material fed to such a separator remains within its confines and one such separator is shown in FIG. 1 of the accompanying drawings.

FIG. 1 shows a typical separator 10 comprising a chassis 12 mounted on a rigid base frame 14. The separator has a motor driven out-of-balance weights vibrator 16 mounted on its side. The chassis 12 contains one or more mesh screens each stretched in a frame which is mounted securely over the hopper.

The separator also comprises a cover 18 (or lid) which is mounted on the chassis, and has an inlet 20 through which material to be separated can be loaded into the separator and has an observation port 21.

The cover 18 is fastened to the chassis in sealed engagement therewith by a plurality of toggle or over-centre clamps 22, the locking action of which secures the cover to the chassis. As good as the seals are that are established with such a structure, in practice, particles of sieved materials do escape from such separators and these particles, being of microfine dimensions can collect on surfaces of the separator and elsewhere, with the attendant possibility of contamination when the separator is used for separating other materials. With the arrangement shown in FIG. 1, this is particularly true of the surfaces of the toggle or over-centre clamps 22, some of which are not readily accessible or visible. Other surfaces which are visible can be cleaned, rinsed and even sterilised where necessary, but the clamps themselves can provide a source of potential contamination because some of their surfaces are not readily visible.

In other prior art arrangements, the cover, screen frame, collection hopper and other elements of the sieve can be clamped together using a single band clamp, comprising a V-section hoop which is tightened around the sieve elements to clamp them together. Effective clamping using individual toggle clamps as in FIG. 1 or the known band clamps requires skill and care on the part of the operator, and the procedure is prone to error.

It is therefore an objective of this invention to provide an improved arrangement for securing or clamping the component parts of the separator together.

Embodiments of the invention can also improve the sealing of the various components, i.e. chassis, cover, sieve frames, so that finely divided products do not escape from the product space in the sieve.

In U.S. Pat. No. 5,226,546, there is disclosed a separator construction in which circular sieve frames can be loaded through slots in a side wall of a cylindrical chassis of the separator and then held in position by inflating an annular inflatable tube with the various components of the separator held in position by one or two strap ties which extend parallel to the axis of the chassis and are located on the outside of the chassis and clamp the component parts together at a maximum of two locations. This, we believe, can lead to distortion of the components of the separator, especially of the screen frames, albeit by a very small amount, but to an extent that does allow leakage of material from the separator.

SUMMARY OF THE INVENTION

Accordingly, in one aspect, the present invention provides screen separating apparatus comprising a chassis for supporting a screen frame carrying a sieve screen, said chassis providing a first bearing surface; and one or more clamping members which can be located relative to the chassis to provide a second bearing surface or a combination of second bearing surfaces opposed to said first bearing surface such that the screen frame can be clamped between the first and second bearing surfaces; wherein the apparatus further comprises at least one expandable element mountable in the chassis to be between said first and second bearing surfaces and expandable to effect said clamping of the screen frame.

The sieve frame is typically circular though it may be of other shape, e.g. elliptical, or even rectangular, and where used herein the terms annular and circumferential or circumference should be understood to include such shapes, unless it is clear that a more specific meaning is intended. Hereinafter, for example, the described and illustrated embodiments use frames which are of circular shape.

Thus, where the chassis accommodates one or more annular frames which are circular, the chassis is typically of circular shape also. The annular clamping arrangement which is conveniently shaped to conform to the shape of the chassis is preferably formed as a cylindrical sheath which fits onto the chassis. This sheath may have an in-turned flange portion which is provided, when the separator is assembled for use, to exert a reactive force, directly or indirectly, onto the sieve frame or a stack of such frames where more than one is used, when the expandable element(s) is/are expanded.

The sheath itself is preferably formed as a one-piece cylinder, though if more desirable, it may be of multipart form, and where of multipart form, the annular construction of the sheath may be provided by a plurality of sheath segments which are, or can be, linked together with, if appropriate, some spatial separation of the sections from each other. A desirable requirement in the design of the sheath is that when the separator is assembled, and the expandable element(s) is/are expanded, the reactive force exerted by the flange portion of the sheath should be exerted not at localised positions, as in the prior art, but uniformly and continuously along as much of the frame(s) as is required to ensure that the frame(s)

and the other components of the separator are subjected to an even distribution of that force.

Where the sheath includes an in-turned flange portion, the sheath itself may extend as a skirt around an upper annular portion of the chassis in overlapping relationship and may have a plurality of cut-out locking slots formed therein to co-operate with spaced studs on the exterior of the chassis in a bayonet fitting relationship so that the sheath and the chassis can be locked together, and readily released, when desired, by a single operative to effect maintenance, cleaning and/or replacement.

The separator may comprise a lid or cover, as is typical of separators generally. The cover may include a shoulder portion around its lower periphery, the shoulder portion being of external dimensions such that it sits within the confines of the chassis and can be engaged by the in-turned flange portion of the sheath. The shoulder portion may also have an inner skirt depending therefrom which itself has a continuous flange at its lower edge, which flange is arranged to rest upon a sieve frame, or an uppermost sieve frame where more than one is provided.

The or each sieve frame is supported within the confines of the chassis. The separator normally comprises a hopper through which sieved materials fall into a collecting receptacle. Such a hopper, in a typical truncated cone shape, may have an upper peripherally-braced shelf portion on which the one or more frames are supported. The shelf portion may have a continuous wall integrally formed with, and upstanding from, the shelf portion, the wall portion being of dimensions such that it forms a snug sliding fit within the chassis. The peripherally-braced shelf portion may itself be supported by the at least one expandable element, which in preferred embodiments of the present invention is a single annular inflatable element which may be provided by an annular inflatable tube or annular bellows mounted in a retaining channel formed by an annular wall extending from an annular ledge welded to the interior of the chassis.

The construction and arrangement of this preferred embodiment is such that, when the separator is assembled, the inflatable member is expanded by pneumatic or hydraulic pressure and urges the hopper, the frame(s) and the skirt of the cover upwardly against the in-turned flange portion of the sheath until the shoulder portion of the cover engages the in-turned flange portion and lifts the sheath until its further movement is prevented by the bayonet fittings. Thereafter, increased pneumatic/hydraulic pressure in the expandable element traps the frame(s) between the skirt of the cover and the shelf portion of the hopper within the sheath and the chassis.

In an alternative embodiment, the engagement of the sheath and the chassis may be provided by forming the sheath with a lower lip arranged to lie under a lower annular edge of the chassis. If the lower lip extends inwardly of the chassis to a sufficient depth, it can support an annular ring that itself supports the expandable element, thereby simplifying the shape of the chassis or the need to weld channelling to the interior of the chassis. Such an annular ring may itself have an annular wall such that an annular channel is formed between it and the chassis to retain the expandable member therein.

The invention also provides screen separating apparatus comprising a chassis for supporting a screen frame carrying a sieve screen, a cover to enclose a space above the sieve screen to contain material to be separated, a hopper to collect fines passing through the sieve screen, at least one inner seal to seal between the cover and the hopper around the circumference of the screen frame when the apparatus is in use, a sheath surrounding said inner seal, at least one outer seal to seal between the sheath and at least one of the cover and the hopper to provide an enclosed volume between the sheath, the cover and the hopper, and an inlet connecting to said enclosed space to enable said enclosed space to be pressurised. This arrangement provides positive leak prevention from the product space in the sieve enclosed by the cover and the collection hopper.

BRIEF DESCRIPTION OF THE DRAWINGS

These and other characteristic features of embodiments of the present invention will now be described by way of example with reference to the accompanying drawings, in which:—

DETAILED DESCRIPTION OF PREFERRED EMBODIMENTS

Figure 1:
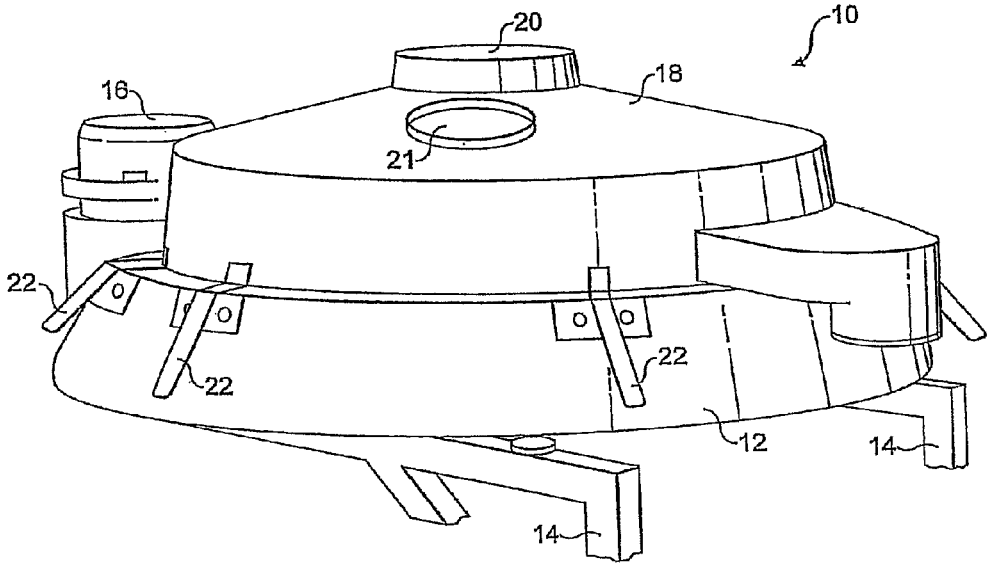
FIG. 1 (Prior Art)
FIG. 1 is a view of a prior art separator.
Figure 2:
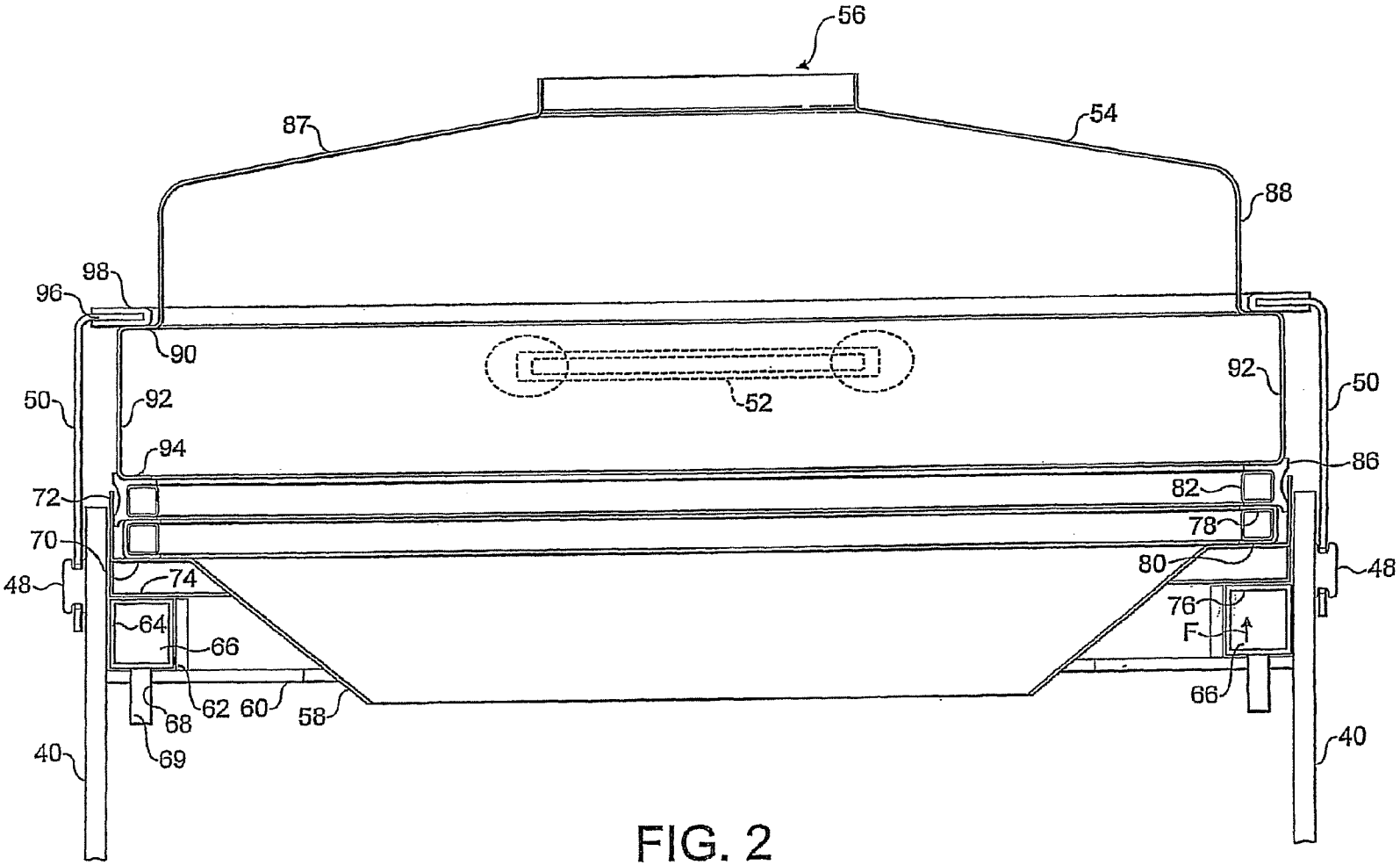
FIG. 2 is a cross-sectional view showing the internal construction of a first embodiment of a separator and apparatus according to the present invention.
Figure 2A:
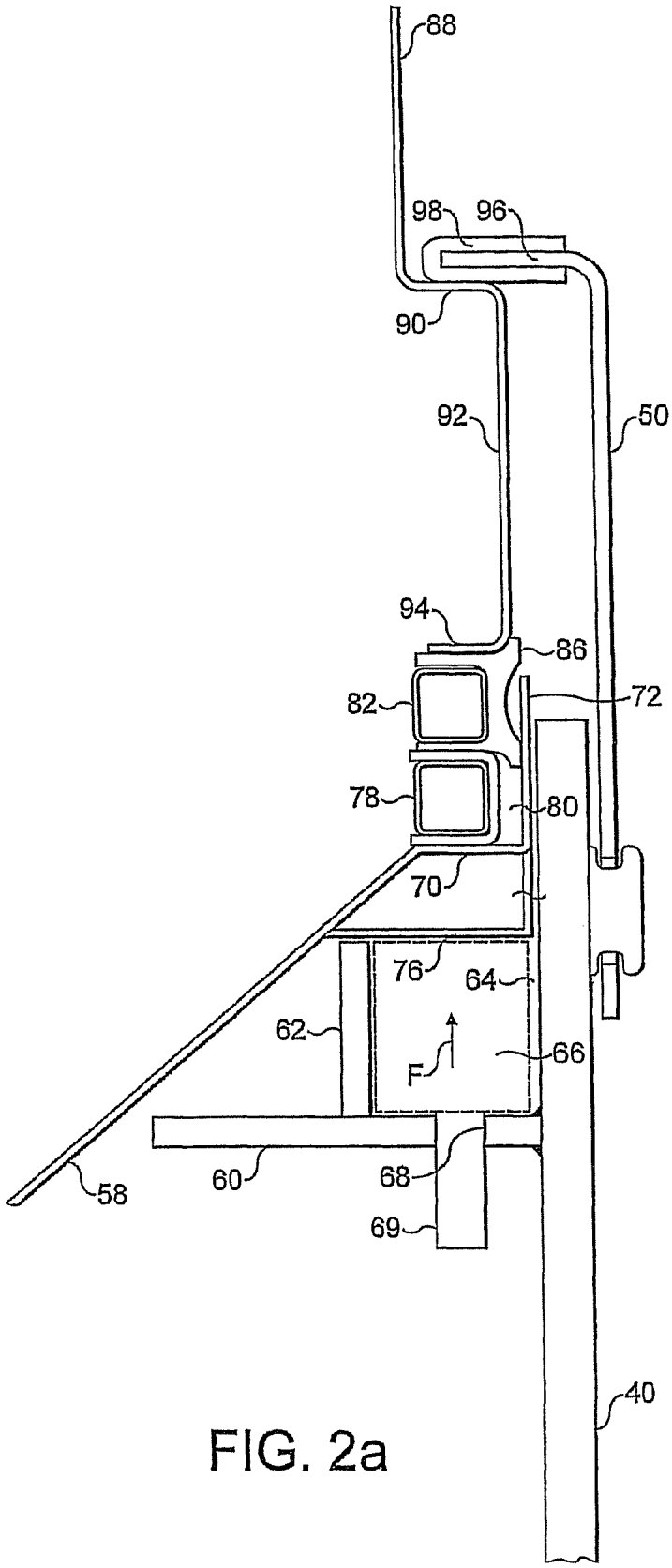
FIG. 2*a* is a close-up cross-sectional view of the right-hand side of the separator shown in FIG. 2.
Figure 10:
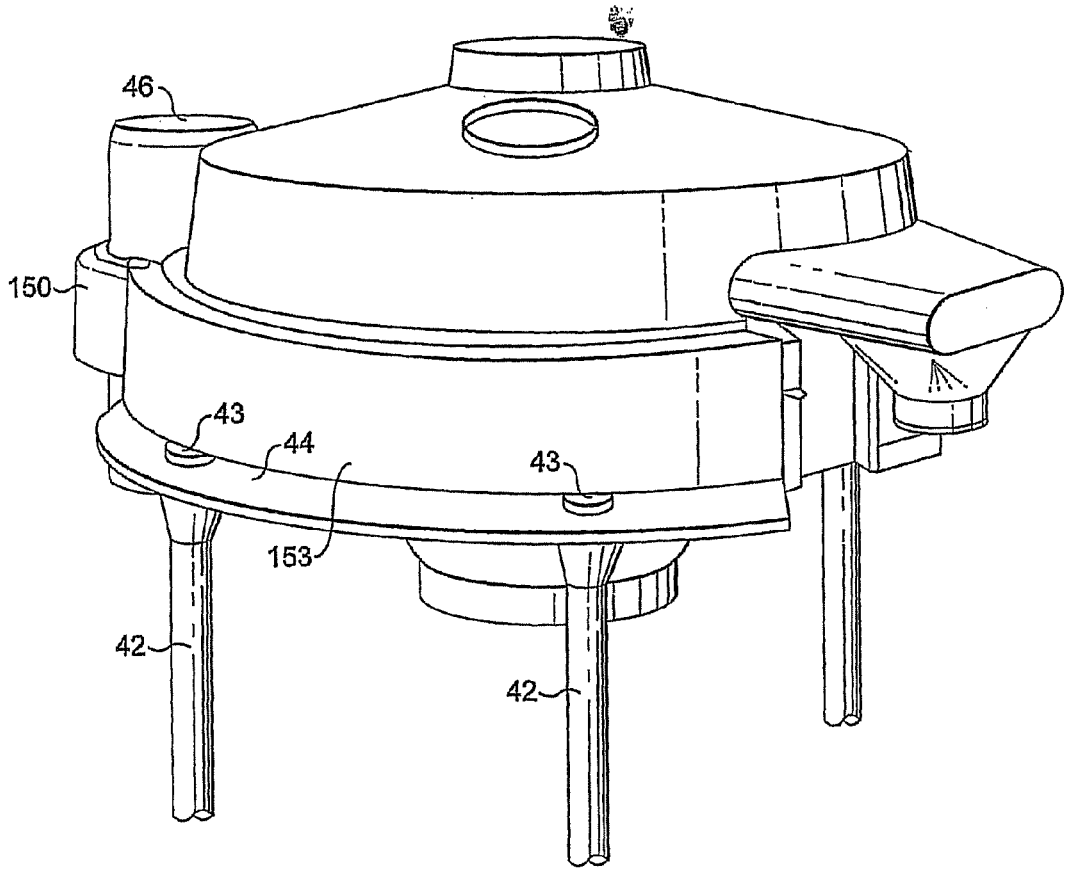
FIG. 10 is a perspective view of a mobile separator according to the present invention illustrating one manner of mounting a sheath of an apparatus according to the invention.
Figure 11:
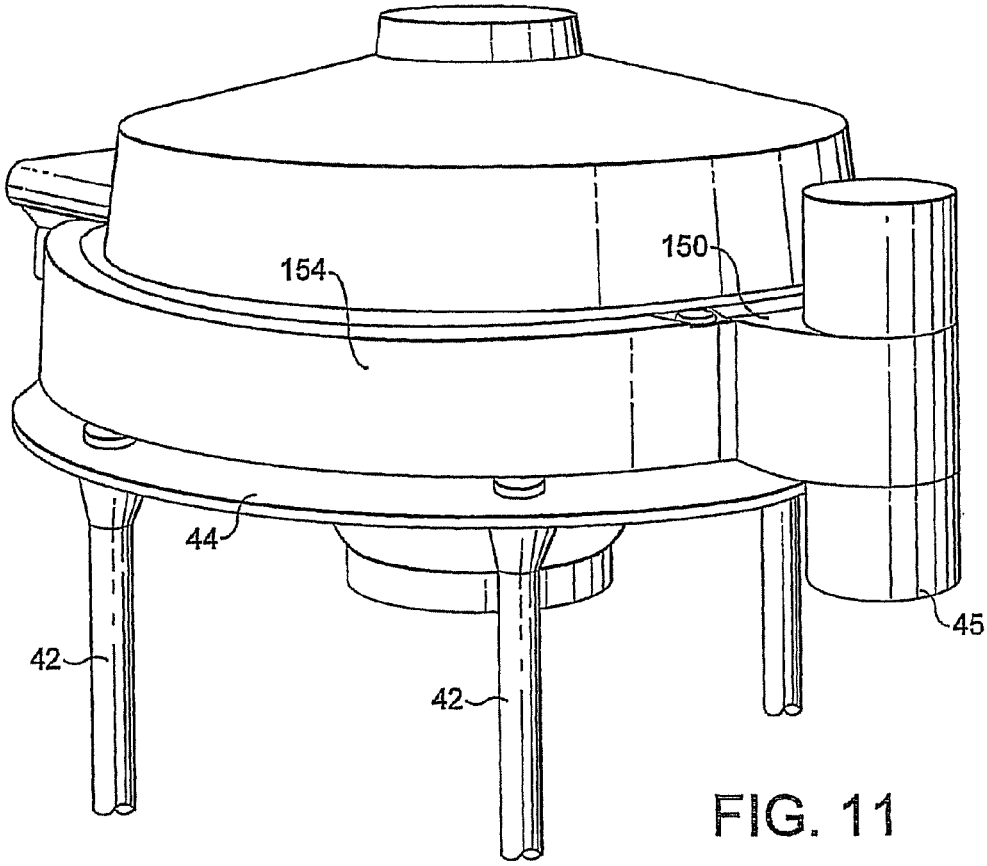
FIG. 11 is a perspective view of the separator of FIG. 10 taken from a diametrically opposite view.
Figure 12:
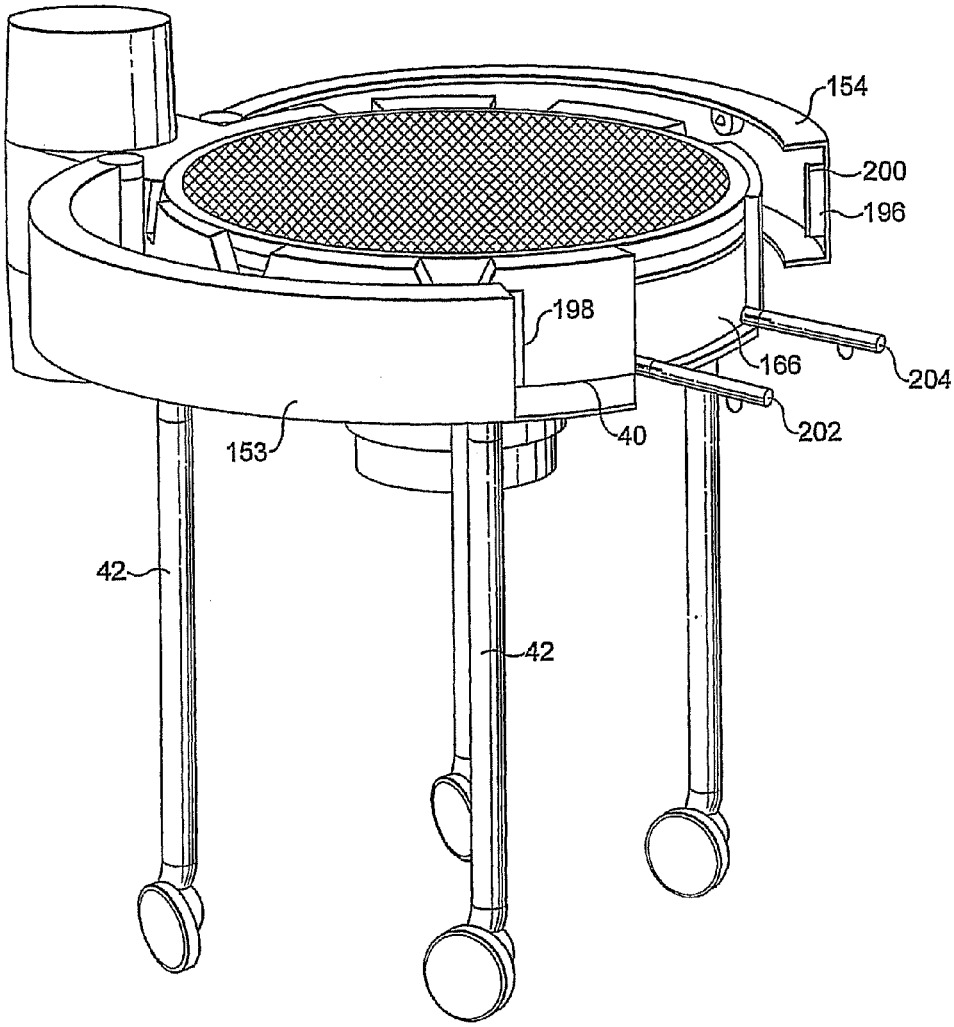
FIG. 12 is a perspective view of the mobile separator of FIGS. 10 and 11 with top cover removed and its sheath in partially separated condition.

FIGS. 2 and 2*a* shows in section a separator embodying the invention comprising a chassis 40 which may be mounted on a mobile carriage 42, which is shown in FIGS. 10 to 12. The chassis 40 is circularly cylindrical having an external diameter normally between 10 cm and 200 cm or more, typically between 40 cm and 120 cm. The chassis 40 is mounted by resilient feet on a platform 44 of the carriage and has a motor 46 attached thereto (not shown in FIG. 2) which is eccentrically weighted to cause the motor to impart vibration to the chassis.

Mounted on the chassis and attached thereto by a plurality of bayonet fittings or couplings 48 of an annular clamping arrangement evenly positioned around the chassis is a sheath 50 which carries diametrically opposed handles 52 to enable the sheath to be coupled to or uncoupled from the chassis. Secured by the sheath is a lid or cover which has an inlet 56 at its uppermost part through which material can be poured into the separator. The cover also has an observation port which is not shown in FIG. 2.

Shown in part section in FIG. 2 is a hopper 58 which is mounted from within the chassis to depend therefrom to funnel sieved material into an appropriate receptacle.

The chassis can be mounted either on a fixed base or a mobile base such as the mobile carriage partly shown in FIG. 2.

Within the chassis 40, there is provided an annular ledge 60 which is welded or otherwise fixed to the interior face of the chassis. This ledge 60 supports an annular wall 62 concentric with and spaced from the interior face of the chassis, the ledge, the wall and the interior face of the chassis, thereby defining a channel 64 which houses an expandable element in the form of an annular inflatable tube 66. The tube is shown in the drawing as being of square cross-section though in practice it may be of any convenient cross-section, or may be of bellows construction.

The ledge 60 is provided with one or more apertures 68 through which one or more inlets 69 to the tube 66 can pass, to a source of pressure such as a pneumatic or hydraulic pump. The tube 66 is inflatable to an extent such that it can rise above the height of the annular wall 62.

The hopper 58 rests on the wall 62, when the tube 66 is not inflated. To this end, the hopper has an annular shelf portion 70 which at its outer periphery extends upwardly as an annular wall 72 which has an external diameter such that it forms a clearance sliding fit within the chassis 40. The shelf portion is supported by an annular collar 74 which is welded to the hopper and is of elbow cross-section to provide a surface 76 against which the tube 66 can be inflated.

The shelf portion 70 of the hopper provides support for a frame 78 of a first or lower sieve screen, the frame 78 being, as previously stated, of circular shape and resting on the upper surface of the shelf portion 70. The frame in this example is of square-sectioned tubular construction and supports a tautly held screen (not shown) therein. The frame is seated in a U-shaped or L-section gasket 80 formed of a suitable preferably conductive resilient material to provide a sealing and locating function, to prevent product by-passing the mesh or escaping to the outside of the sieve. Mounted above the first, lower, frame 78 is a second, upper, frame 82 of similar construction to that of frame 78. The two frames 78 and 82 are separated by an annular gasket 86 which provides a similar function to gasket 80. The gasket 86 is also shaped to brace the two frames away from the wall 72 of the hopper 58, and extends over the top of the frame 82 to provide a seat for the cover 54. Frame 78 may carry the secondary separator mesh or screen and frame 82 may carry a primary safety mesh or a magnetic separator. Instead frame 78 may be just a spacer, and frame 82 may carry the single mesh or screen.

The cover 54 is of generally circular cylinder shape having a shallow truncated cone top portion 87 which includes the inlet 56 at its apex. Around the lower perimeter of the main cylindrical part 88 of the cover is formed a shoulder portion 90, depending from which is an annular, inner skirt 92 which lies inside the sheath 50. At its lower edge, the skirt 92 is formed with an in-turned annular flange 94, which rests upon the gasket 86 over the spacer 82.

When the sheath 50 is located in position over the cover 54, an annular in-turned flange portion 96 formed around the upper edge of the sheath 50 overlaps the shoulder portion 90 of the cover 54. The flange portion 96 is encased in a resilient annular gasket 98 to seal with the shoulder portion 90 of the cover. As with the other gaskets, the gasket 98 may be formed of any suitable resilient material (e.g. silicone, polypropylene).

As can be understood from a study of FIG. 2 especially, the apparatus is assembled onto the chassis 40 by firstly locating the inflatable tube 66 within its channel 64 and then fitting the hopper 58 into the chassis interior so that the hopper rests on the innermost edge of the wall 62 with the lower surface 76 of the collar 74 overlying the inflatable tube or bellows 66.

Thereafter, gaskets 80 and 86 are fitted to the frames 78 and 82, the frame 78 is placed on the shelf portion 70 of the hopper 58, and the second frame 82 is then placed on the first, lower, frame 78 and pressed into position.

The cover 54 is placed on the spacer 86, and the sheath then fitted over the cover so that the protected flange portion 96 seats on the shoulder portion 90 of the cover. The sheath is 'dropped' over the cover so that the openings to slots 47 (see FIG. 18) in the sheath are aligned with studs 48 on the chassis 40 to form bayonet fittings. Then, when the sheath is lowered as far as permitted by the slots 47, the sheath is twisted so that the studs 48 are engaged in the slots to prevent the sheath from being lifted off again.

Once the sheath 50 is so engaged, and holds the cover 54 in place, the inflatable tube 66 is inflated via a pump (not shown) filling the tube with compressed air or other suitable fluid causing the tube to inflate. Inflation of the tube causes expansion of the tube, and the expansion exerts an upward force, as indicated by the arrow F, on the collar 74 thereby pressing the shelf portion 70 against the two frames 78, 82, and transmitting this force, via the flange 94, skirt 92 and shoulder portion 90, to the flange portion 96 of the sheath 50. The sheath is thus caused to take up any slack in the bayonet fittings.

Thereafter pressure caused by inflation of the tube 66 causes compression of the gaskets 80, 86 and 98 until the components of the separator are tightly secured.

Figure 18:
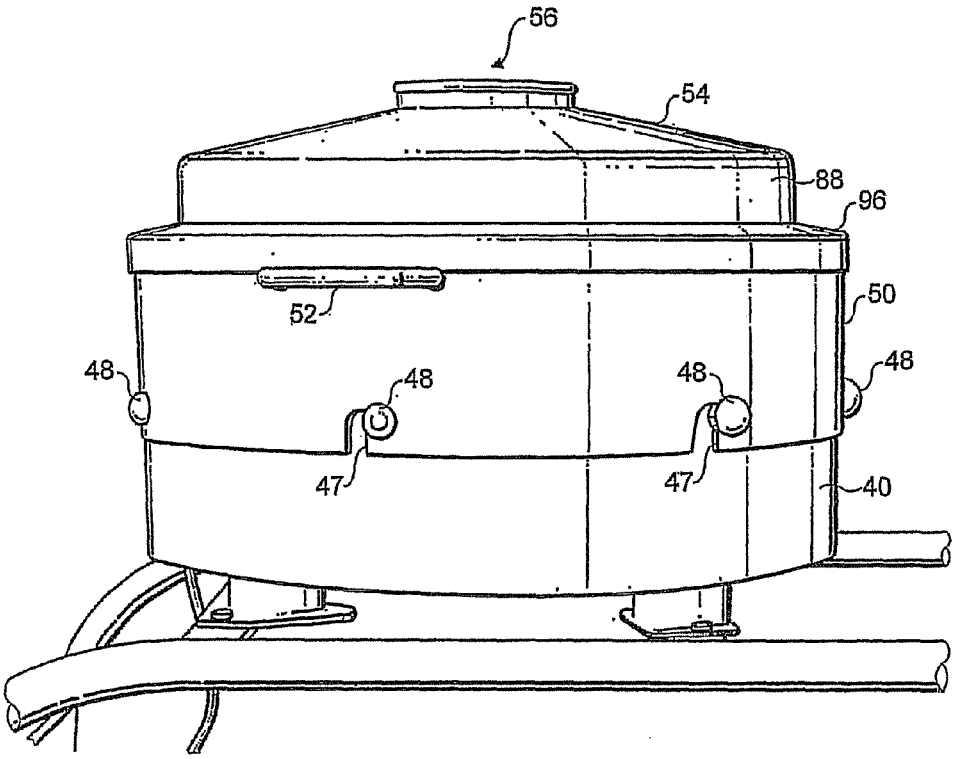
FIG. 18 is a perspective view of the embodiments of separator with bayonet-type connections between the sheath and the chassis.

A perspective view of the separator of FIGS. 2 and 2*a* is shown in FIG. 18, which best illustrates the bayonet couplings with studs 48 and slots 47.

FIG. 2 shows a construction employing two frames 78, 82. More than two frames may be used, in which case a sheath having sufficient depth to accommodate the height of the frames is required. Alternatively, the studs of the bayonet fittings may include a screw-threaded section, and the chassis can then be provided with threaded apertures at different heights so that change in the number of frames can be accommodated by changing the position of the studs.

Figure 19:
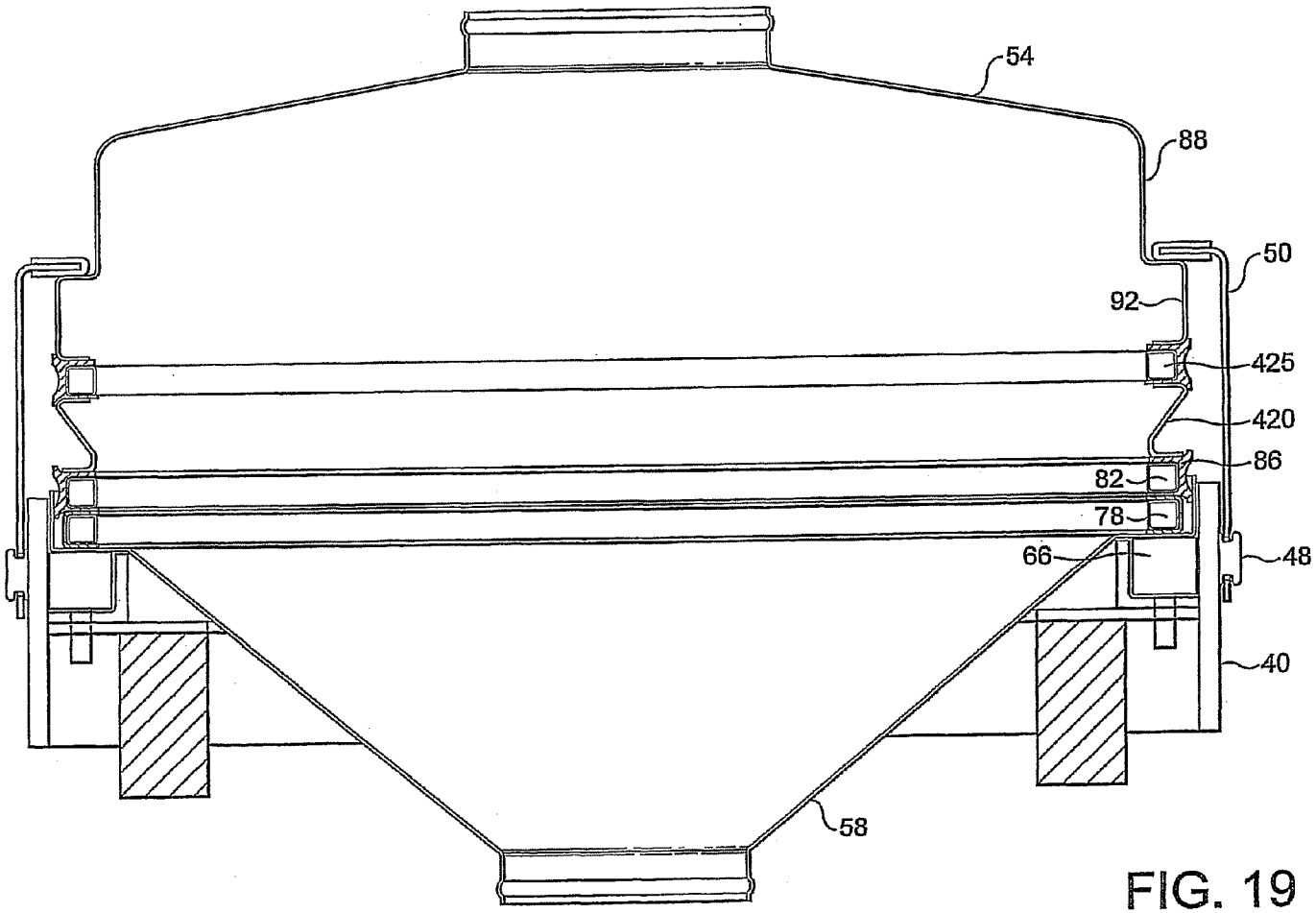
FIG. 19 is a cross-sectional view of a further embodiment with two stacked screen decks.

In other embodiments, the separator may have two or more stacked screen decks carrying progressively finer sieve screens. Then the sheath has sufficient depth to clamp together the multiple decks and screen frames. A separator with two sieve decks is shown in FIG. 19 having an upper deck unit 40 clamped between an upper screen frame 425 and the lower frame 82.

Figure 3:
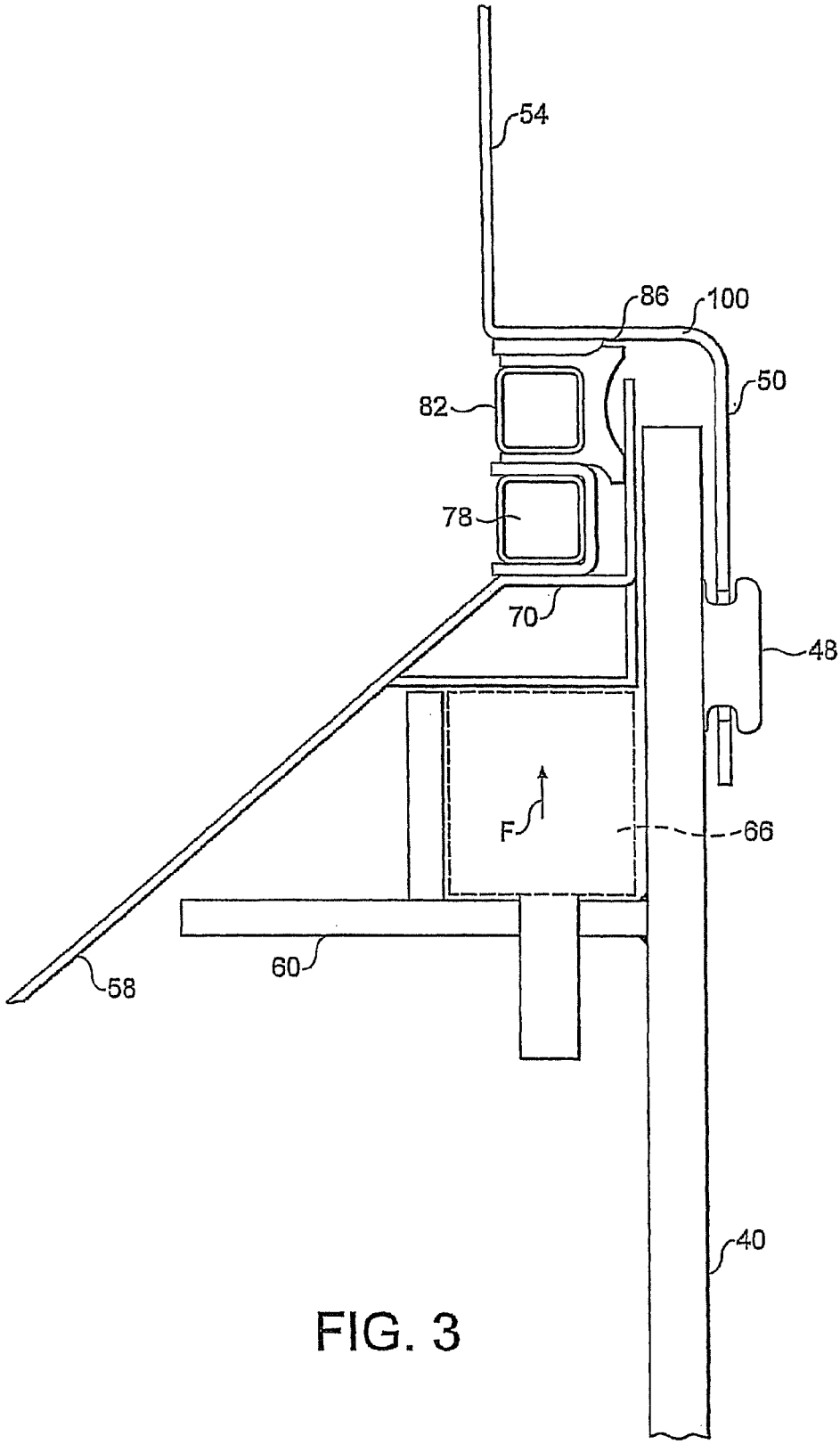
FIG. 3 is a cross-sectional view similar to FIG. 2*a* but illustrating a second embodiment of the invention.

In a second embodiment of the present invention, shown in FIG. 3, the sheath 50 is formed integrally with the cover 54. As can be seen from comparison with FIG. 2, the sheath 50 is foreshortened and comprises an extended skirt portion joined to the main cylindrical body of the cover 54 by a shoulder portion 100 providing a peripheral flange that seats against the spacer 86. This construction removes the necessity for a separate sheath. In all other respects, the second embodiment is substantially identical to the first embodiment.

Figure 4:
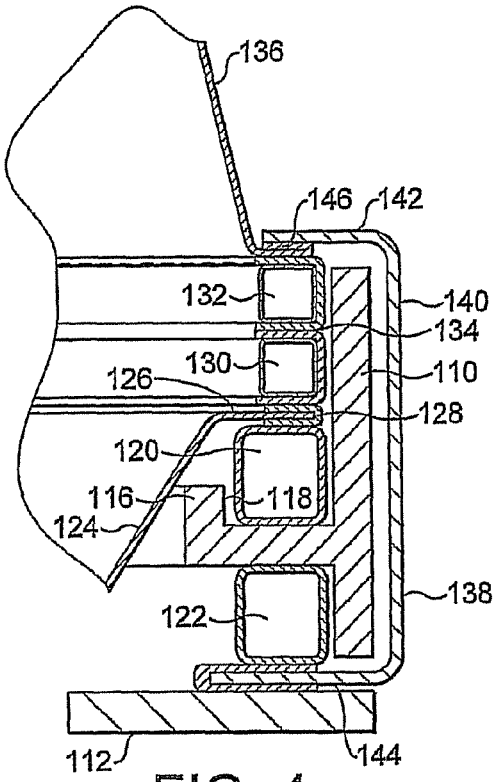
FIG. 4 is a cross-sectional view similar to FIG. 2*a* but illustrating a third embodiment of the invention.

A third embodiment of the present invention is shown in FIG. 4, wherein a cross-section of a part of a separator illustrates a chassis 110 which is mounted on a base 112. The chassis is cylindrical and of annular shape when viewed in plan. The chassis has an annular ledge 114 which is welded or otherwise formed fixed to the interior face of the chassis 110 and this annular ledge supports an annular wall 116 concentric with and spaced from the interior face of the chassis, so that the ledge, the wall and the interior face of the chassis define a channel 118. As in FIG. 2, the channel 118, like the channel 64, houses an expandable element in the form of an annular inflatable tube 120 similar to the tube 66 of FIG. 2.

The ledge 114 is located within the confines of the chassis 110 at a position such that a second expandable element, also in the form of an annular inflatable tube 122 can be located below the ledge 114 and within the confines of the chassis.

The separator comprises a hopper 124 which has an annular shelf portion 126 which is protected by a resiliently compressible annular gasket 128. The shelf portion 126 rests on the inflatable tube 120.

The shelf portion 126 supports first, lower and second, upper sieve frames 130, 132 which are mounted in an annular resiliently compressible annular gasket housing 134 on which is supported the cover 136 of the separator. The cover, though of different appearance from that shown in FIG. 2, nevertheless has the same function as that of cover 54 therein and includes an inlet through which material can be delivered to the sieve screens and an optional observation port.

In this embodiment, a sheath 138 which is of annular form, and of multipart construction, as hereinafter described, envelops the chassis 110 almost completely. The sheath 138 has a skirt portion 140 which embraces the exterior of the chassis 110 and integrally-formed upper and lower in-turned annular flanges 142, 144 respectively. The lower flange 144 extends inwardly below the chassis 110 to provide support for the inflatable tube located below the ledge 114, and the upper flange 142 extends inwardly to overlap a peripheral flange 146 of the cover 136, thereby trapping the two frames 130, 132, shelf portion 126 and the two inflatable tubes 120 122.

When either or both of the tubes 120, 122 is/are inflated, pressure is exerted by the tube 122 on the lower flange 144 and, by inflation of the tube 120, on the frame housing 134 and thus against the upper flange 142. Due to the compressible nature of the gasket 128 and of the housing 134, the structure thus assembled is held fast and can withstand vibration imparted to the separator without leakage of material therefrom.

Figure 5:
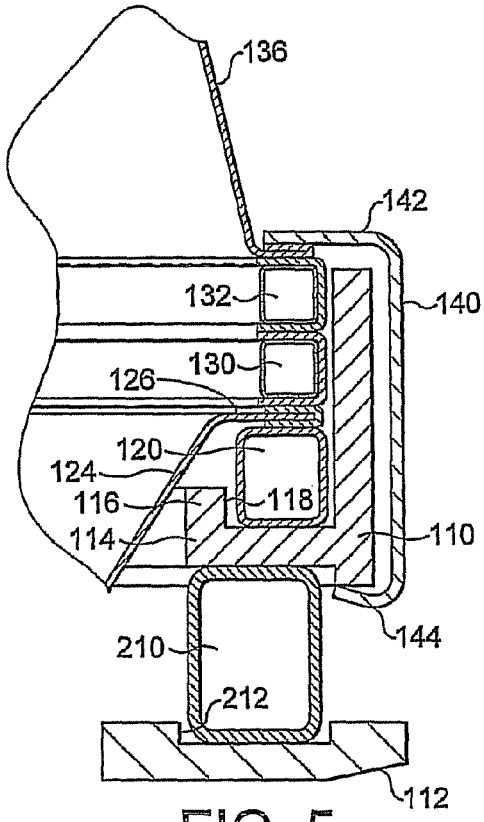
FIG. 5 is a cross-sectional view similar to FIG. 2*a* but illustrating a fourth embodiment of the invention.

Turning now to FIG. 5, there is shown therein a fourth embodiment of the present invention which is similar to that of FIG. 4 (the same reference numerals are therefore used, where appropriate, as are used in FIG. 4), except in that the lower inflatable tube 122 is removed completely and the annular ledge 114 is supported directly on anti-vibration mounts 210 in spaced relationship to the base 112 of the separator. Without the presence of the inflatable tube, the in-turned lower flange 144 of the sheath 140 only engages the lower edge of the chassis 110.

Figure 5A:
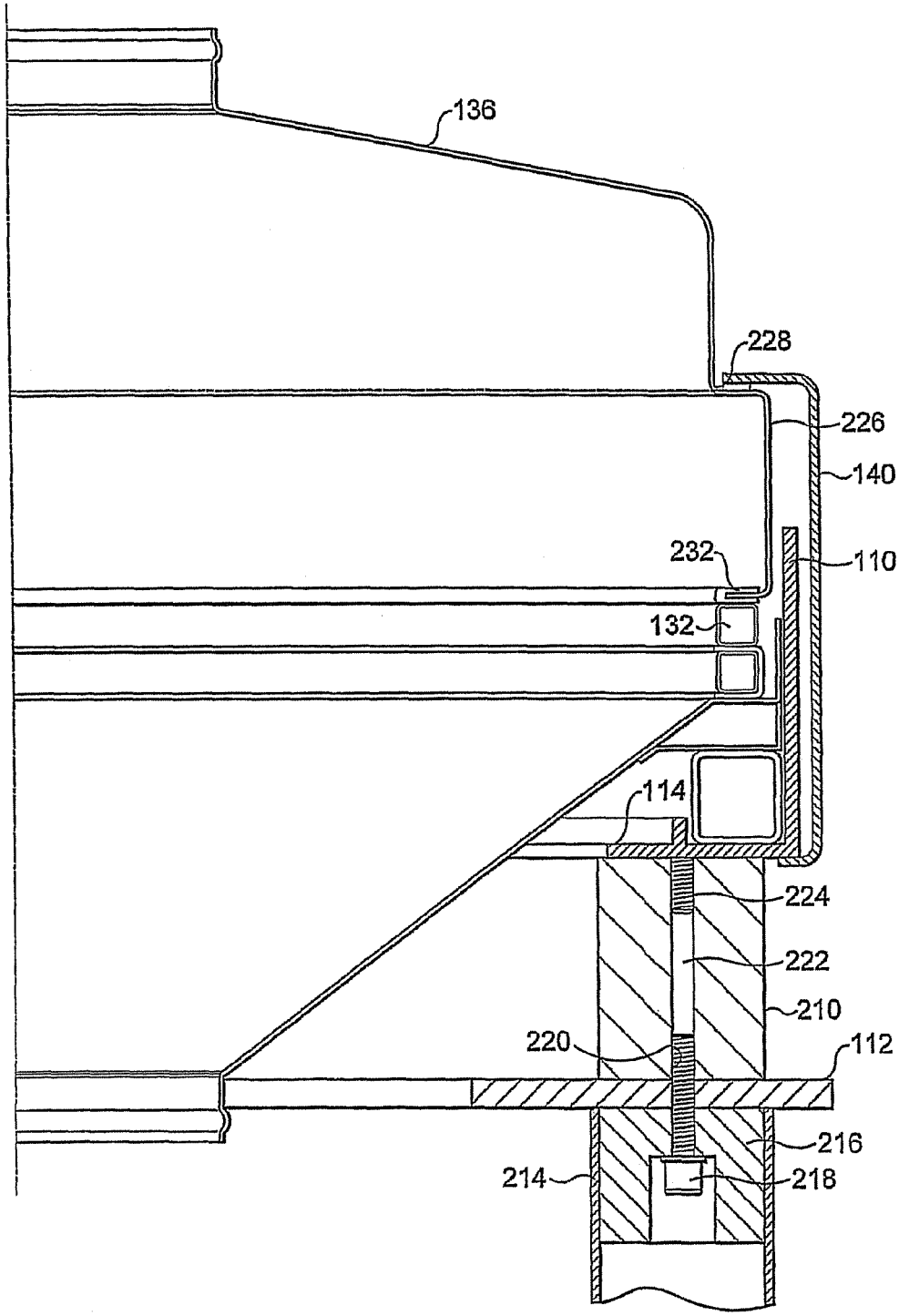
FIG. 5*a* is a cross-sectional view of a variant of the fourth embodiment shown in FIG. 5.

The resilient mounts 210 are formed of any suitable material, e.g. vulcanised natural or synthetic rubbers, or plastics materials, capable of absorbing vibration transmitted from the motor, so that the base remains substantially vibration free during use, and are located in recesses 212 provided in the base 112. Mounts in the form of springs may also be used. Further detail of the construction of the fourth embodiment can be gleaned from the variant thereof which is shown in FIG. 5*a*. In this Figure is shown the manner in which the ledge 114 is used to anchor the chassis 110 to the base frame 112. Each support 214 for the base frame 112 has a bush 216 mounted on its upper extremity, the bush being recessed to receive the head of a bolt 218 which extends upwardly through an aperture in the base frame 112 and partially through a bore 220 in the resilient mount 210 to engage an internally threaded coupling 222 housed in the lower part of the bore 220. A further bolt 224 countersunk into the ledge 114 engages a further internally threaded coupling housed in the upper part of the bore 220.

As stated above, the construction shown in FIG. 5*a* is a variant of that shown in FIG. 5. In this FIG. 5*a* embodiment, it can be seen by comparison with FIG. 5 that the chassis 110 and the sheath 140 are extended upwardly above the upper screen frame 132, and that the cover 136 has a skirt portion 226 analogous to the skirt portion 92 of the first embodiment shown in FIG. 2, the skirt portion 226 extending from a shoulder portion 228 of the cover to an in-turned flange encased in a gasket 232 seated on the upper screen frame 132.

Figure 6:
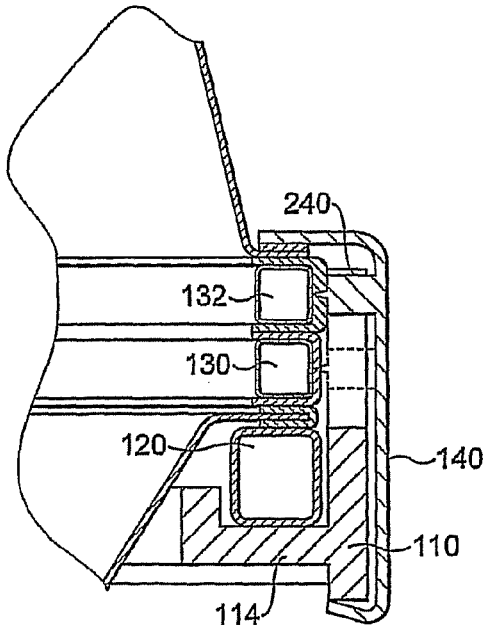
FIG. 6 is a cross-sectional view similar to FIG. 2*a* but illustrating a fifth embodiment of the invention.

In FIG. 6, a further, fifth embodiment of the present invention is illustrated. One factor that has to be considered in the construction of a separator according to the invention is that of earthing the separator to ensure that static charge does not build up on the separator or on the screen frame and so cause potential harm to an operator or charge particles delivered to the sieve screens. The embodiment of FIG. 6 provides a solution.

The construction of the embodiment of FIG. 6 is very similar to that of FIG. 5. The significant difference therefrom is that in the FIG. 6 embodiment, the sheath 140 is provided with a plurality of earthing probes 240 which extend through apertures provided therefor in the chassis 110. Where only a single screen frame is employed in the separator, then one or more probes 240 can be provided, aligned with the plane of the frame but, where two or more screens, and therefore screen frames, are provided, probes are provided for both frames. The probes are provided with tapers whereby they can pierce the resilient gaskets protecting the frames. In all other respects, the construction of the embodiment of FIG. 6 is closely similar to that of FIG. 5. It will of course be clearly understood that the provision of earthing probes is equally applicable to all embodiments of the present invention. Instead of the illustrated earthing probes, the parts of the separator may be earthed using electrically conductive material for the resilient gaskets, or interconnecting with earthing braids.

Figure 6A:
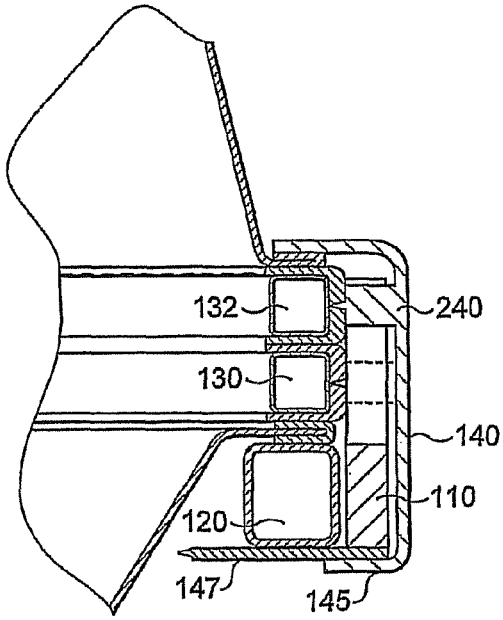
FIG. 6*a* is a cross-sectional view similar to FIG. 6 of a modification of that embodiment.

A modification of the embodiment shown in FIG. 6 can be seen in FIG. 6*a*, wherein the chassis is foreshortened and does not include a ledge 114. Instead, the chassis 110 is formed as a simple cylinder while the sheath 140 has an in-turned flange 145 that extends inwardly further than the flange 144 of FIG. 6, and supports an annular ring 147 that in turn abuts against the lower edge of the chassis 110 and supports the inflatable tube 120.

The manner in which a sheath such as is illustrated in FIGS. 4 to 6*a* can be mounted in a separator according to the invention is shown generically in FIGS. 10, 11 and 12. In FIGS. 10 and 11, the separator is viewed from opposite sides. The motor 46 has a flange 150 secured to a mating flange on chassis 166 (see FIG. 12). Chassis 166 corresponds to chassis 40 of FIGS. 2, 2*a* and 3 and to chassis 110 of FIGS. 4 to 7)

As can be seen in each of FIGS. 10, 11 and 12, the sheath 138, is formed in two halves 153, 154 each of which is a mirror image of the other and extends around almost one half of the chassis 166 save for the motor mount, against side faces of which adjacent ends of the sheath halves abut, as described below.

Figure 11A:
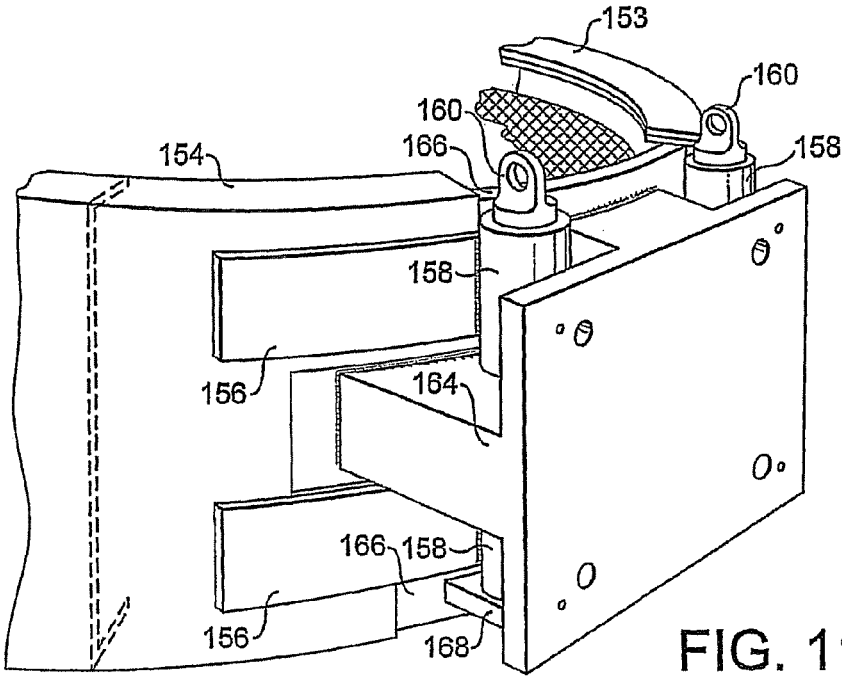
FIG. 11*a* is a close-up perspective view of a motor mounting block shown in outline in FIG. 11.
Figure 11B:
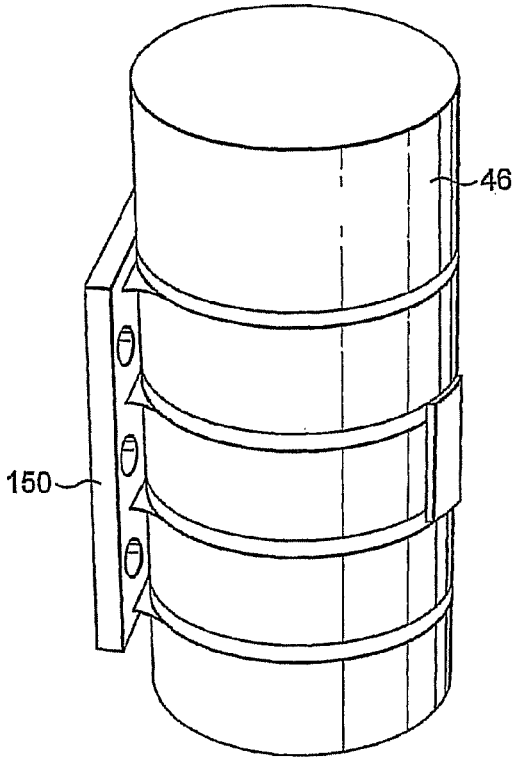
FIG. 11*b* is a further close-up perspective view of a motor housing of a separator according to the present invention, the housing being mountable to the mounting block shown in FIG. 11*a;*

As shown in detail in FIG. 11*a*, which illustrates the manner of mounting of the sheath halves 153, 154 on a typical chassis 166 of a separator according to the present invention, the two halves 153, 154 of the sheath each have a pair of hinge plates 156 welded thereto, each plate of a pair having an integral bush 158 for receiving a steel hinge pin 160 which passes through both bushes of each pair.

Each hinge pin 160 passes through a respective pin hole which is formed in a mounting block 164 which is welded to the chassis 166, and through a bearing aperture in a retaining plate 168 which is welded in situ between the mounting block 164 and the chassis 166.

Figure 11C:
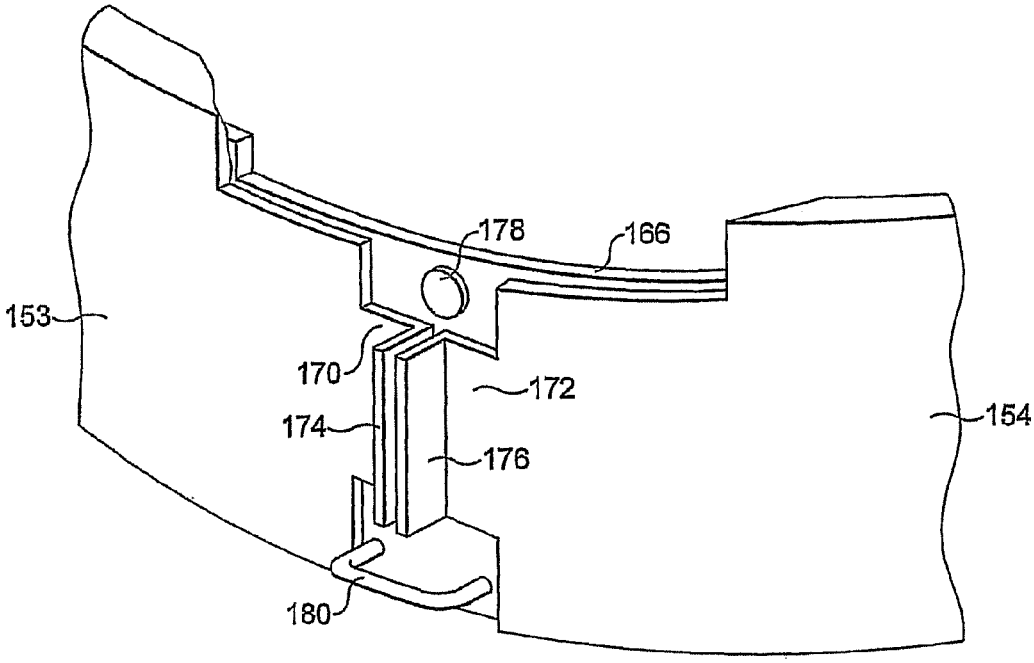
FIGS. 11*c* to 11*e* are perspective views of details of a closure arrangement for holding the sheath of the apparatus of FIGS. 10 and 11 in closed position.
Figure 11D:
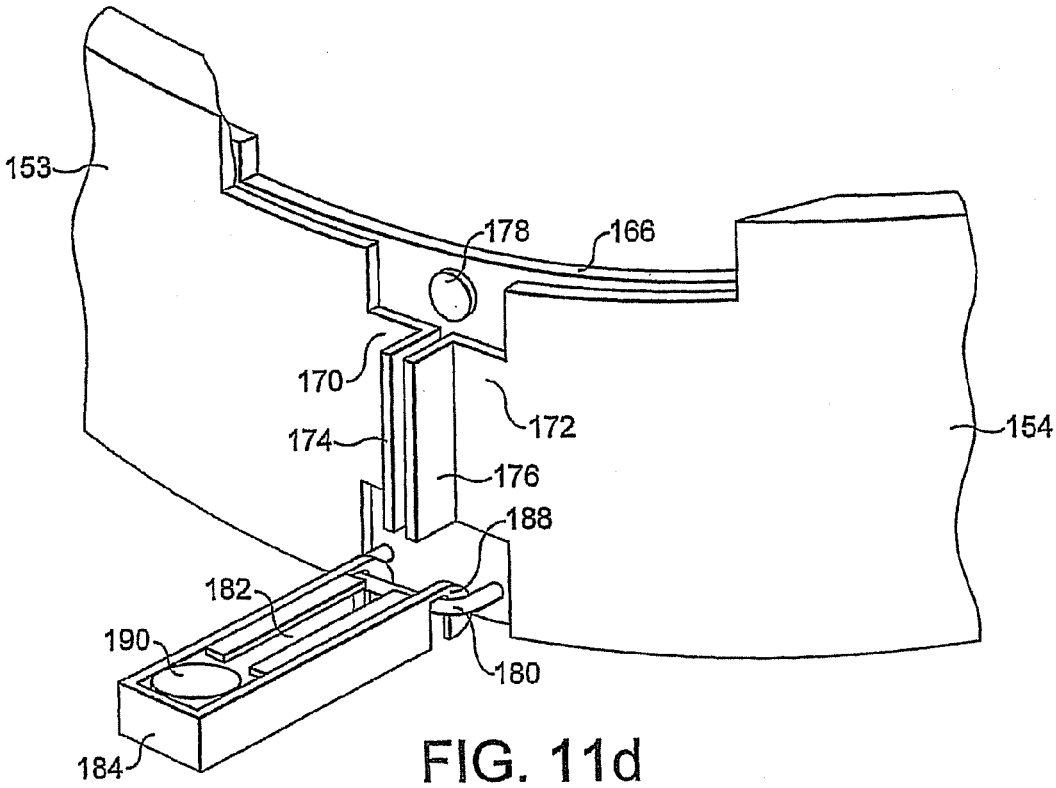
Figure 11E:
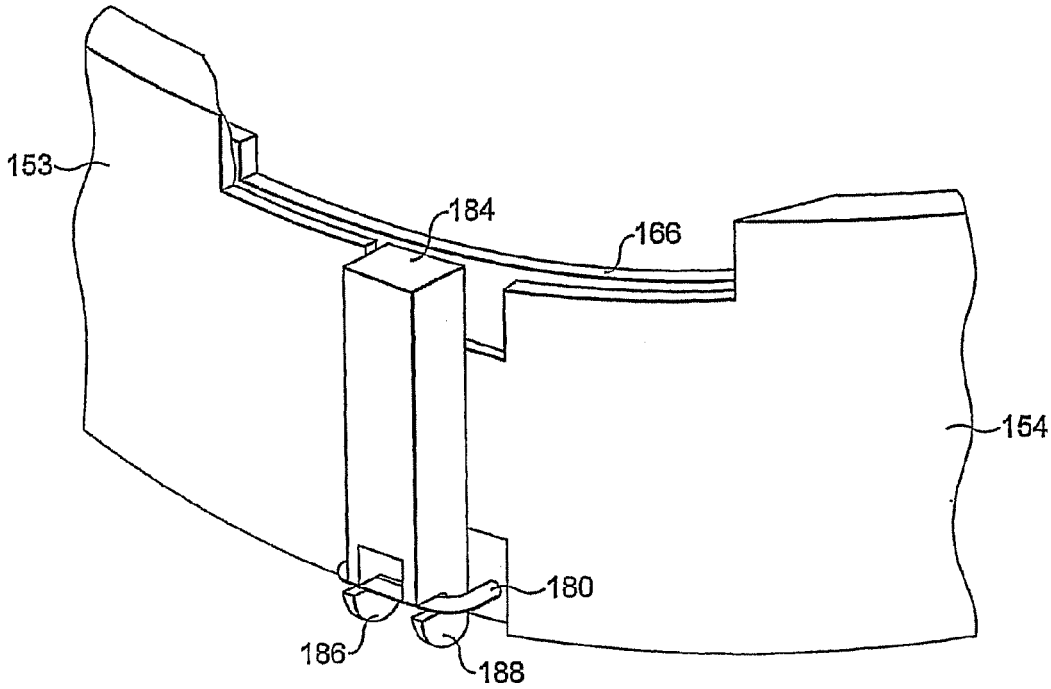

At their opposite ends, i.e. those ends opposite the hinges, the two halves 153, 154 of the sheath, when closed onto the chassis are in substantially end-to-end relationship, as shown in FIGS. 11*c*, 11*d* and 11*e*. At these adjacent ends, each half 153, 154 of the sheath is formed with a tongue portion 170, 172 respectively, which includes an out-turned flange portion 174, 176 respectively. These tongue portions 170, 172 are positioned flush against the outer surface of the chassis 166 between a magnetic keeper 178 mounted on the chassis 166 and a U-shaped horizontal hinge 180 welded or otherwise attached to the chassis.

When the two halves 153, 154 are closed onto the chassis 166, the two flange portions 174, 176 are in closely-separated relationship, the separation corresponding to the width of a slot 182 formed in a magnetic locking bar 184 which is used to clamp the two halves 153, 154 together on the chassis 166. The bar 184 is provided with a pair of hooks 186, 188 which hook over the horizontal hinge 180 to act as a pivot for the bar 184. At its opposite end, the bar 184 has a magnet 190 inset into the body of the bar. This magnet 190 co-operates with the magnetic keeper 178 to hold the locking bar 184 in situ when it is moved from the position shown in FIG. 11*d* to that shown in FIG. 11*e*. The magnetic locking bar/keeper arrangement described above may use permanent magnets or electro-magnets.

This construction permits ready locking of the two halves 153, 154 of the sheath 152 and quick release when it is required to uncouple them. The two halves can then be parted and swung back from the chassis 166 as shown in FIG. 12, and completely removed from the chassis of the separator by removal of the two hinge pins 160 and then lifting away from the chassis 166 with equal ease of re-mounting when the separator is again required for use. Instead of the magnetic arrangement described, an over-centre latch may be used to secure the halves of the sheath together.

As mentioned above, the collar 150 of the motor is mounted on the mounting block 164.

The manner in which the separator can be assembled and dis-assembled is shown in FIG. 12, which shows a mobile version of the present invention. As illustrated in FIG. 12, the cover of the separator has been removed and the two halves 153, 154 of the sheath released and are swung away from the chassis 166, either prior to removal of a screen frame or prior to closure of the two halves after replacement or cleaning of such a frame of frames.

In the structure shown in FIG. 12, there is also shown a variant of the locking system for locking the two halves 153, 154 against the chassis 166. Instead of the tongue portions 170, 172 shown in FIGS. 11*a* and 11*c*, the two halves 153, 154 have tongue portions 194, 196 (194 not shown) which are turned inwards from the surface of the respective half 153, 154, with each tongue portion having a flange portion 198, 200 at right angles thereto.

Pivotally mounted on the chassis 166 are two toggled hinge pins 202, 204 that can pivot between a horizontal position as shown in FIG. 12 and an upright position parallel with the external face of the chassis 166 in which they engage the flange portions 194, 196 to retain the latter in position against the chassis.

With such an arrangement, the two halves of the sheath 152 can be quickly released, and subsequently coupled around the chassis 166.

Figure 7:
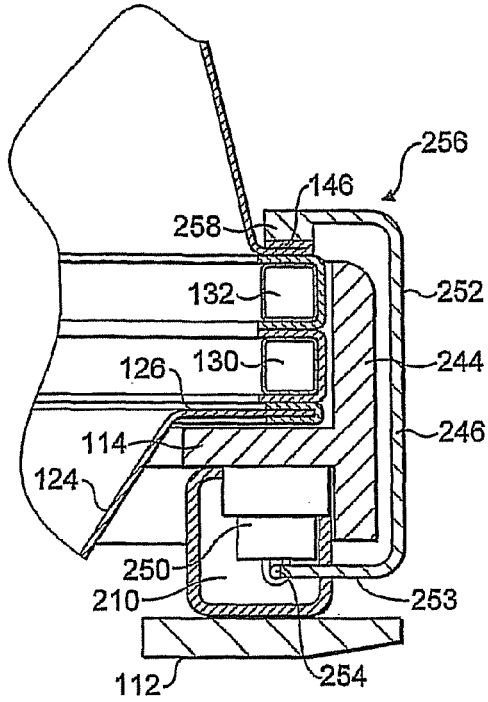
FIG. 7 is a cross-sectional view similar to FIG. 2*a* but illustrating a sixth embodiment of the invention.

Turning now to FIG. 7, there is shown therein a further, sixth embodiment of the present invention. In this embodiment, the ledge 114 does not have an internal annular wall 116 and the shelf portion 126 of the hopper rests on the ledge with the two frames in turn supported on the shelf portion.

In this embodiment, a further variation from the preceding embodiments is that the at least one expandable element is provided by a plurality of pneumatic (or hydraulic) piston-and-cylinder arrangements 250 which are mounted on and secured to the base 112 and extend upwardly therefrom to engage the underside of the annular ledge 114.

In this construction, and in that of the seventh embodiment of the present invention, shown in FIGS. 8, 9 and described below, a different arrangement is provided for mounting the sheath 138 relative to the chassis 244 of the separator.

The construction shown in FIG. 7 employs a sheath 246 which is formed by a plurality of sheath segments 252 instead of the two sheath halves shown in FIGS. 10, 11 and 12. The manner in which the segments are mounted and can be moved is shown generally in FIGS. 13 and 14, to which further reference will be made below.

In the embodiment of FIG. 7, lower in-turned flange portions 253 of the sheath segments 252 are shown pivotally coupled to the piston-and-cylinder arrangements 250 by pivot pins 254 such that each segment can be pivoted from a non-engaging position to the position shown in FIG. 7. Each segment 252 has an upper in-turned flange portion 256 which overlaps a peripheral flange 146 of the cover and carries a resilient gasket 258 which is adapted to engage the peripheral flange 146 along the circumferential length of the segment.

Figure 8:
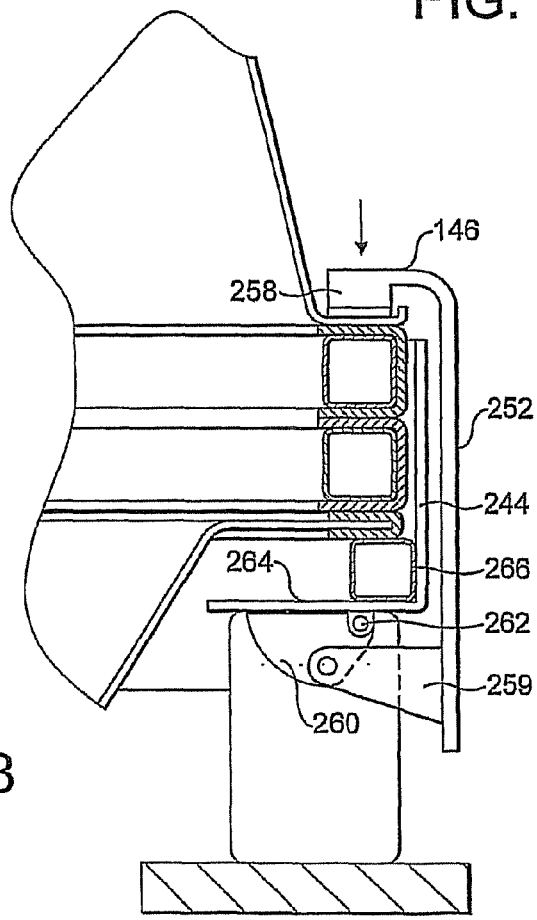
FIG. 8 is a cross-sectional view similar to FIG. 2*a* but illustrating a seventh embodiment of the invention.
Figure 9:
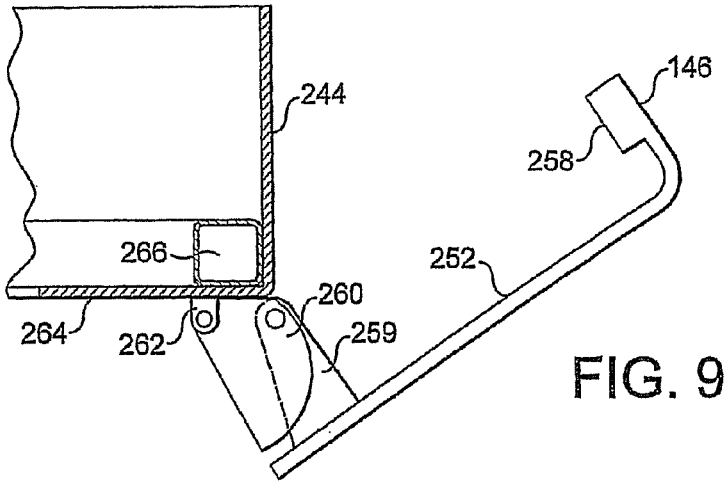
FIG. 9 is a cross-sectional view of a detail of FIG. 8.

A similar arrangement is shown in FIGS. 8 and 9 wherein, instead of being hingedly coupled to the piston-and-cylinder arrangements 250, the sheath segments 252 are each mounted on a plate 259 which is pivotally coupled to a hinge plate 260 which is itself similarly coupled to a bracket 262 welded to the underside of an in-turned flange 264 of the chassis 244.

The positions of the pivotal couplings of the sheath segment plates to their respective hinge plates, and of the hinge plates to their respective brackets is such as to provide a toggle arrangement as shown in FIG. 9.

In FIG. 8 an expandable element 266, similar to those used in earlier embodiments is located between the flange 264 and the annular shelf portion 126 of the hopper 124.

Figure 13:
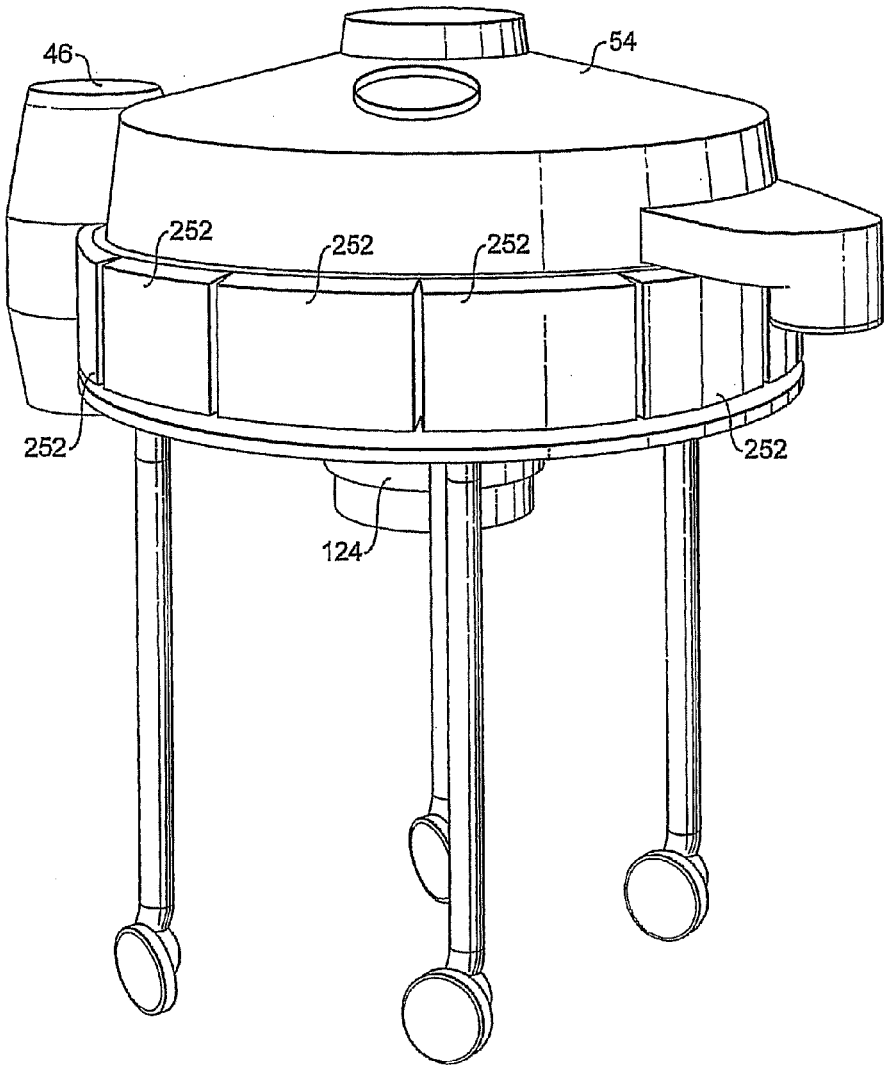
FIG. 13 is a perspective view of a mobile separator illustrating a second manner of mounting a sheath of apparatus according to the present invention.
Figure 14:
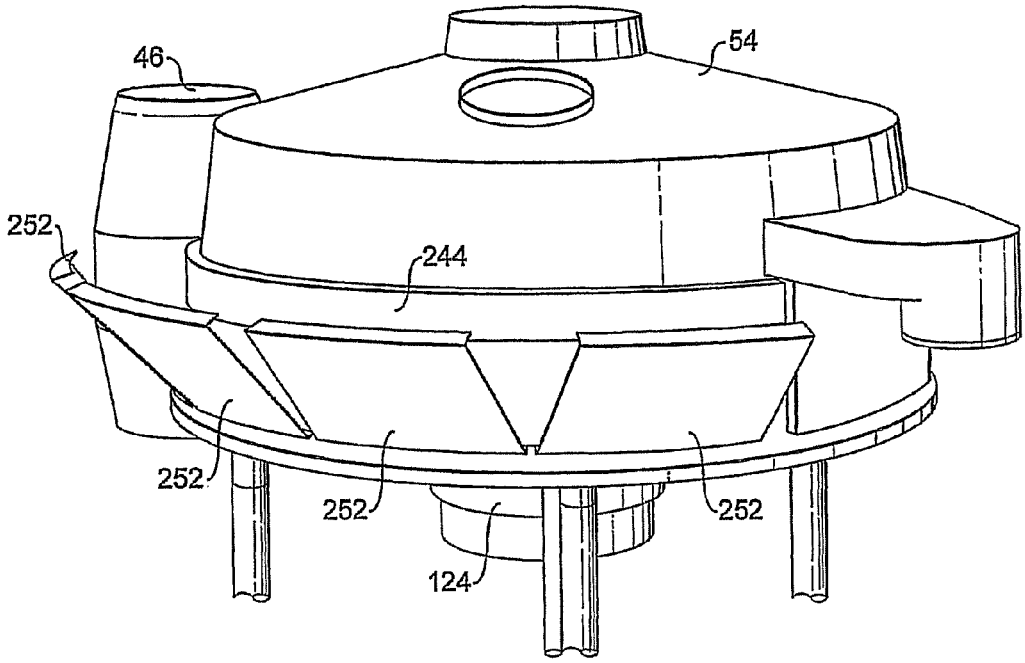
FIG. 14 is a perspective view of the separator of FIG. 13 showing the sheath in released condition.

The general construction using a plurality of sheath segments 252 can be seen in FIGS. 13 and 14, and by comparison with the constructions shown in FIGS. 10 to 12. In place of the two sheath halves 153, 154 of those Figures, the embodiment of FIGS. 13 and 14 comprises nine equally sized sheath segments 252.

All of the sheath segments 252 are pivotal on mountings such as described with reference to FIGS. 7 to 9, and are toggled when in the chassis enclosing position shown in FIG. 13, as described with reference to FIG. 8, or otherwise can be held in position, as with the embodiment of FIG. 7, by expansion of the piston-and-cylinder arrangements thereof.

To release the segments from the positions shown in either of FIGS. 7 and 8, the pneumatic/hydraulic pressure is first released to allow the segments to be pivoted outwardly from the chassis 244, as in FIG. 7.

In either construction, the segments then adopt the position shown in FIG. 14 to permit the cover to be removed for the purpose of replacing or carrying out maintenance of the screens and/or the interior of the separator.

Figure 15:
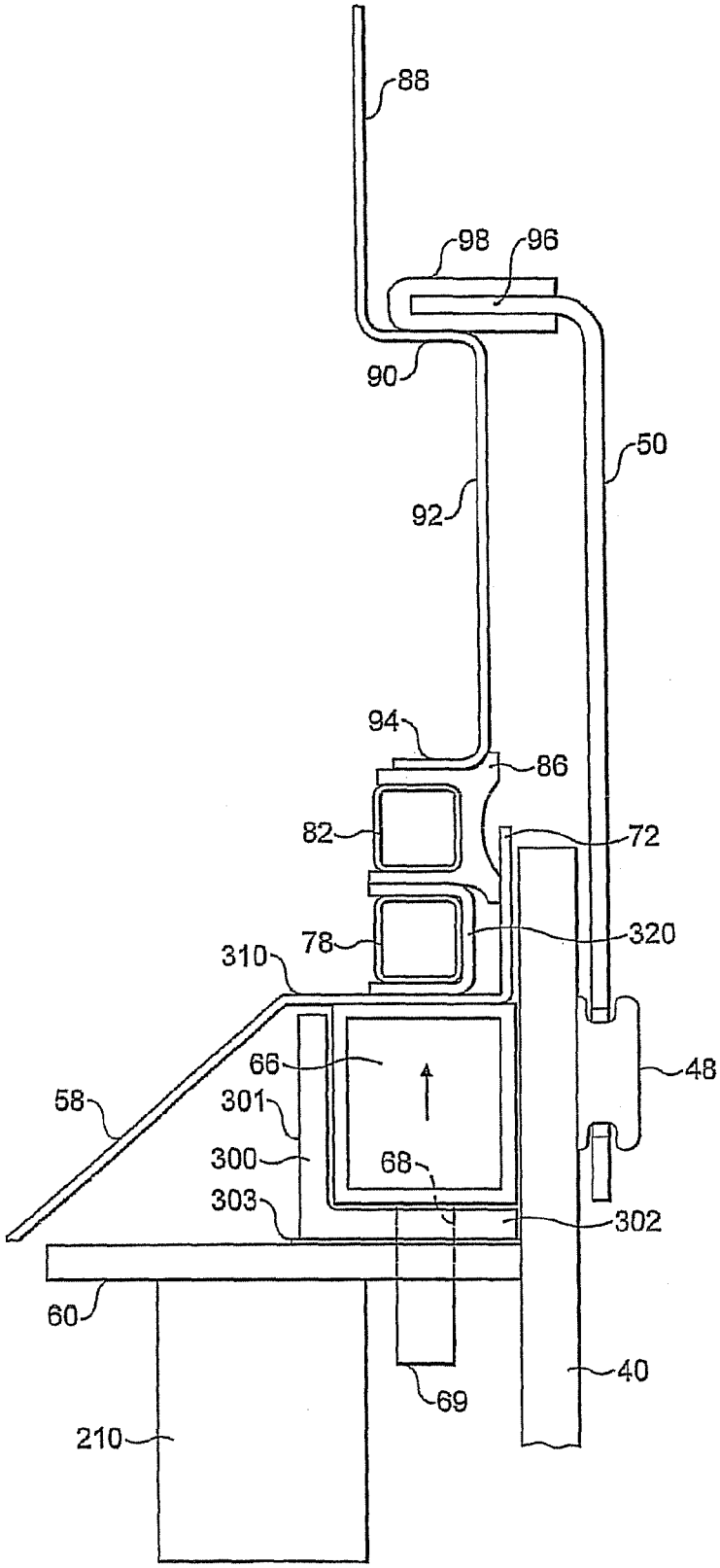
FIG. 15 is a cross-sectional view of a variant of the first embodiment shown in FIGS. 2 and 2*a;*

FIG. 15 shows an improvement of the first embodiment described above with reference to FIGS. 2 and 2*a*. Components of the apparatus which are the same or similar as in the first embodiment are identified with the same reference numerals.

Instead of the annular wall 62 welded or otherwise fixed to the annular ledge 60 as described and illustrated in the first embodiment and shown in FIGS. 2 and 2*a*, in the modification shown in FIG. 15, there is an angle ring 300 providing an upwardly extending flange 301 corresponding to the annular wall 62 of the first embodiment, and a horizontal annular flange 302 which fits inside the outer wall of the chassis 40. A flat annular gasket 303 supports the angle ring 300 on the annular ledge 60.

The angle ring 300 effectively provides the annular channel 64 of the first embodiment and as illustrated in FIGS. 2 and 2*a*, which contains the expandable element or annular bellows 66. When the bellows 66 is expanded under pressure as described previously, the annular gasket 303 provides a good seal between the angle ring 300 and the annular ledge 60 of the chassis.

Importantly, the annular ring 300 and the gasket 303 can be removed from the chassis structure to facilitate cleaning.

An additional modification in the embodiment of FIG. 15 is the design of the annular shelf portion of the hopper 58. In the embodiment of FIG. 15, the hopper 58 has an outwardly extending flange portion 310 which is now of sufficient radial width that the radially inner part of the flange portion 310 can rest directly on the upper edge of the vertical flange 301 of the angle ring 300, when the bellows 66 is not inflated. The mesh frame 78 then rests directly on the upper surface of the annular flange 310, and the bellows 66 acts directly on the under surface of the annular flange 310.

Importantly, this design avoids the enclosed space defined by the annular shelf portion 70 and lower surface 76 of the hopper 58 in the first embodiment as illustrated in FIGS. 2 and 2*a*. Such enclosed spaces can be undesirable, especially when the separator is used for processing pharmaceuticals.

Finally, as can be seen in FIG. 15, the gasket 80 of the first embodiment in FIG. 2*a* is a U-shaped gasket 320 as shown in FIG. 15.

In other respects, the modified embodiment of FIG. 15 is the same and operates in a similar fashion to the first embodiment as described previously. The chassis is mounted on the base by resilient mounts 210.

Figure 16A:
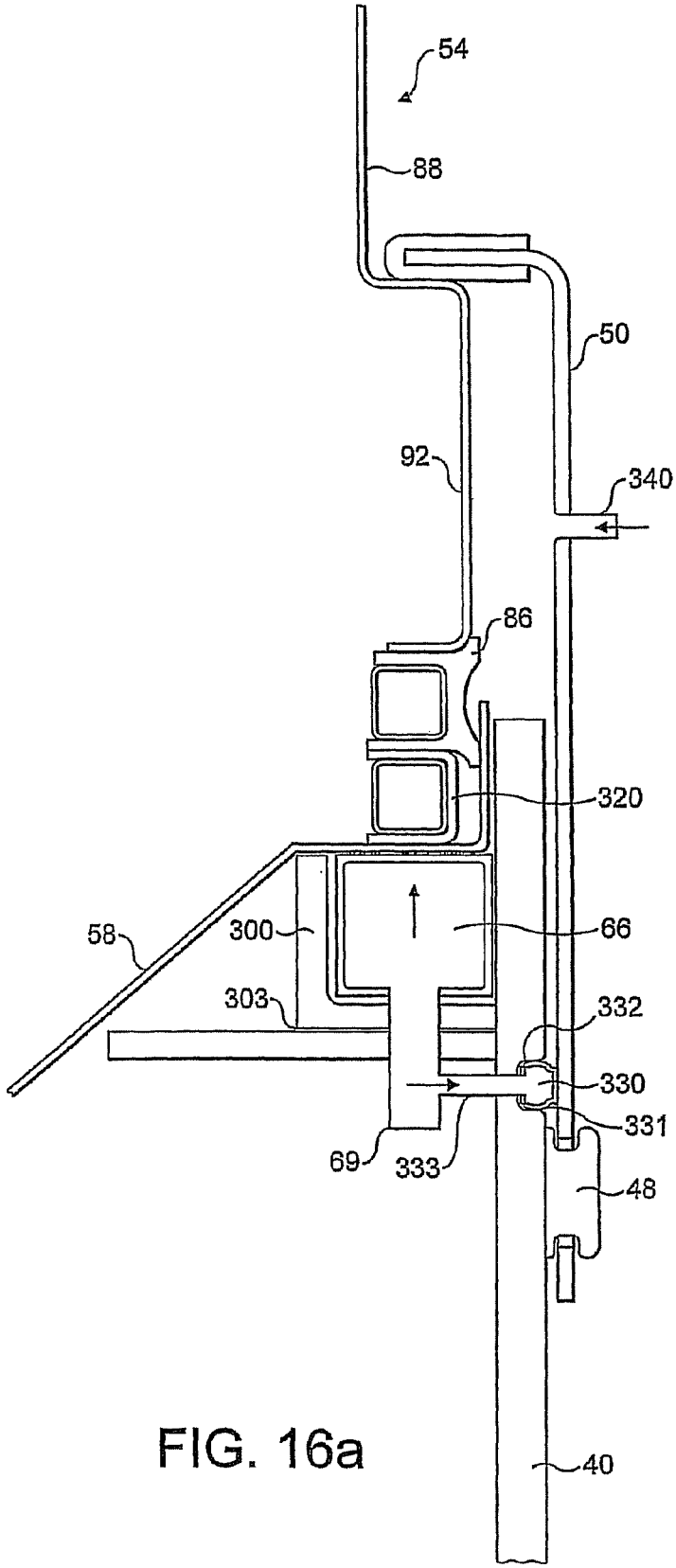
FIG. 16*a* is a cross-sectional view illustrating a further modification providing positive prevention of leaks and cross-contamination.

FIG. 16*a* illustrates the modified embodiment of FIG. 15 with a further modification which allows positive leak prevention from the sieve. An additional circumferential seal 330 is provided between the sheath 50 and an outer surface of the chassis 40. In the illustrated embodiment, this seal 330 may comprise an annular inflatable tube 331 mounted in a groove 332 formed in the outer face of the chassis wall. The tube 331 is connected by a supply conduit 333 to the pressurised gas inlet 69 for the main inflatable bellows 66, so that when the bellows 66 is inflated, so also is the tube 331 so as to form a gas-tight seal between the chassis 40 and the sheath 50. Other sealing arrangements may be used for seal 330, such as a simple (non-inflatable) O-ring or annular gasket.

In addition a gas connection 340 is provided at an upper part of the sheath 50 so that the interior space defined by the sheath unit 50, the inner skirt 92 of the lid or cover, the gaskets 86 and 320, the periphery of the hopper 58, the bellows 66, the angle ring 300, the annular gasket 303, the annular ledge 60, and the chassis wall 40, can be pressurised, e.g. to 0.5 bar gauge. This over pressure then prevents any residual leakage from within the sieve product space through the seals between the cover 54 and the hopper 58. Also, leakage of possibly contaminating ambient air into the product space is prevented.

It is not critical to provide a perfect seal between the sheath 50 and the chassis and cover, so long as the desired over pressure can be maintained. However, a pressure sensing leak detection system may be provided if required to monitor the over pressure in the region enclosed by the sheath 50.

Figure 16B:
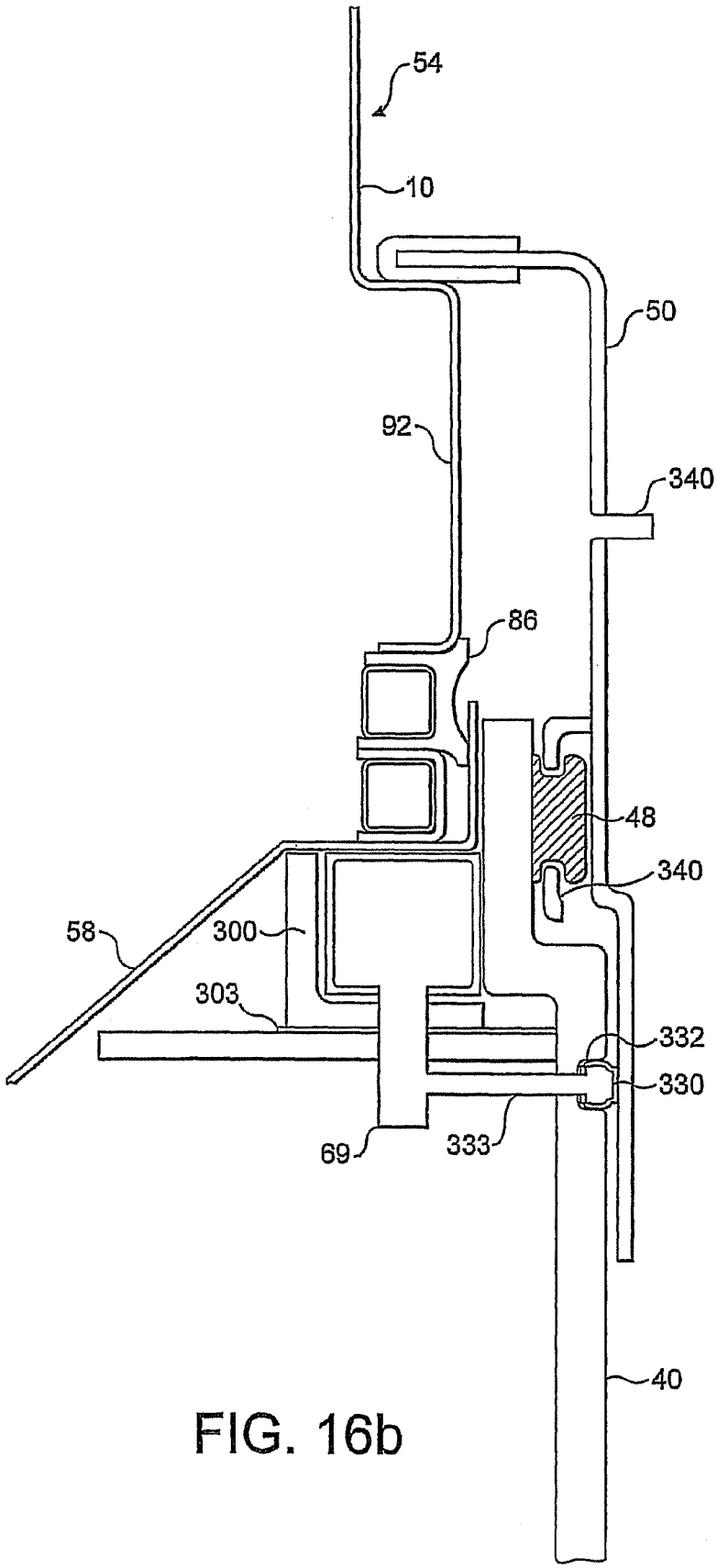
FIG. 16*b* is a cross-sectional view of a further modification.

FIG. 16*b* illustrates a variation of the arrangement for positive leak prevention using internal bayonet fittings comprising studs 48 engaging in slots provided in an internal flange 340 secured to the inside face of the sheath 50. This variation provides a smoother exterior surface to the assembled separator.

The positive leak prevention system may also be applied to the separator with integrally formed cover and sheath of FIG. 3. Then an inflatable or O-ring seal such as seal 330 in FIGS. 16*a* and 16*b* may be provided between the sheath or extended skirt portion 50 of the cover of the FIG. 3 embodiment and the chassis 40, conveniently at a location above the studs 48 of the bayonet fittings. Seal 86 for the sieve frame 82 makes a good seal with the shoulder 100 of the cover, when clamping pressure is applied by the bellows 66. A gas connection (not shown in FIG. 3) can be provided through the skirt portion 50 to pressurise the space bounded by the skirt portion 50, the shoulder 100, the frames 82 and 78, the hopper 58, the bellows 66 and the chassis 40.

Figure 17:
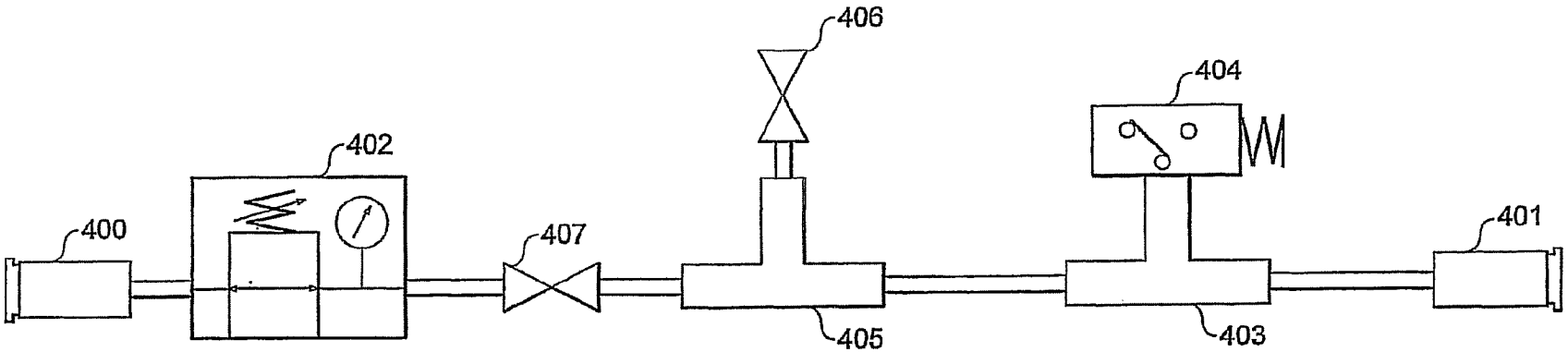
FIG. 17 is a schematic diagram of a preferred pneumatic control system for embodiments of the invention.

FIG. 17 illustrates a pneumatic control system which may be used with embodiments of this invention.

A supply of pressurised air is connected at push connector 400 and is fed to the bellows 66 (together with the annular sealing tube 331 if fitted) by means of an outlet push connector 401. The pressure supplied to the sieve through the outlet 401 is controlled by a pressure regulator and gauge unit 402.

A T-piece 403 in the pressure line supplies the applied pressure to a pressure sensor 404 which may be connected to disable the main sieve motor on detection of an applied pressure below a predetermined threshold, e.g. 5 bar. For example, the pressure sensor 404 may be connected to one of the starter coils in the starter box of the separator.

The pneumatic control system also includes a second T-piece 405 connecting to exhaust via an exhaust valve 406. In addition an isolator valve 407 enables the inlet pressure supply to be isolated from the sieve.

In operation, the bellows 66 of the separator unit is inflated to apply the required clamping pressure by closing the exhaust valve 406 and opening the isolation valve 407. These valves may be manual. Then, so long as the applied pressure as sensed by the sensor 404 exceeds the threshold (e.g. 5 bar) the sieve can be started in the usual way. If the applied pressure drops below the threshold, the sieve stops automatically and cannot be restarted until the pressure is restored.

If the leak detection system of FIG. 16 is fitted, an additional sensor may detect pressure change in the scaled region behind the sheath 50 and again stop the sieve until corrected.

It will be clearly understood from the foregoing description of various embodiments of the invention, that various combinations, other than those described, of the characteristic features of the invention are possible without departing from the scope of the invention so defined by the claims. For example, the sheath could be formed of various combinations as a hybrid of the structures shown in FIGS. 10, 11 and 12 and FIGS. 13 and 14 whereby the sheath can be formed of segments which are themselves pivotally connected about vertical pivots to fold back about a hinge such as that shown in FIGS. 10 to 12. It will also be appreciated that the expandable elements of the various embodiments can be interchanged according to what is optimum for requirements.

In embodiments described above, the expandable element is an inflatable continuous tube or annular bellows extending around the circumference of the screen frame. However, in other embodiments, multiple lengths of inflatable tube or bellows elements may be used distributed around the screen frame to provide a substantially even clamping force.

In another embodiment the annular bellows may be replaced by an annular ring and at least two pneumatic or hydraulic rams operable to drive the ring to effect said clamping.

Other embodiments may use magnetic force to provide the expansion force for said expandable element or elements. Electro-magnets may be employed which can be switched on and off to apply clamping when required. Opposed permanent magnets may also be used and rotated from an opposing position when switching from repulsion (providing clamping pressure) to a released non-repelling position.

It should also be clearly understood that, though described in specific arrangements, it is possible to rearrange the assembly of the frame(s) and expandable element(s) can be adjusted, provided that a clamping arrangement is achieved with the sheath enclosing the chassis. Thus, for example, the arrangement shown in FIG. 4 could include two inflatable tubes, one above and one below the shelf portion 126 of the hopper 124.

The various embodiments of the invention described above have the following advantages:

a) By providing one or more expandable members essentially inside the outer structure of the separator, the outer structure can be substantially "cleaned up" to minimise external crevices and other surface structures which can trap unwanted dirt or contaminants.

b) The clamping arrangements described, in particular that using the single clamping sleeve located around the cover of the separator structure, substantially simplifies the operation of clamping the various screening elements together, so that operator error is minimised.

c) The provision of pneumatic or hydraulically operated inflatable elements to provide the clamping pressure permits a reliable clamping pressure to be applied and provides the possibility of automatic pressure monitoring for added security.

d) Embodiments of the invention ensure that the clamping pressure is applied substantially uniformly around the entire circumference of the sieve frame, thereby improving sealing between the various clamped elements of the separator.

e) The additional provision in embodiments of the invention of an over pressure in the enclosed region between the sleeve and the clamped elements of the separator, enables positive leak prevention from the product space within the separator and prevents incursion of contaminants from ambient atmosphere.

The embodiment providing positive leak prevention which is described above and illustrated in FIG. 16, also incorporates the features of FIG. 2 relating to securing and clamping together the various elements of the separator. It should be understood, however, that the positive leak prevention arrangement can be used with other designs of separator, for example designs which need not incorporate the one or more expandable elements to clamp the screen frame between a first bearing surface associated with the chassis of the separator and a second bearing surface associated with a clamping element. The positive leak prevention arrangement can be applied to sieves with prior art clamping arrangements sealing together the hopper and cover around the screen frame of the separator, modified to include a sleeve which is sealed to one of the hopper and cover so as to define the required enclosed space encompassing the clamp seals between the separator components.

Figure 20:
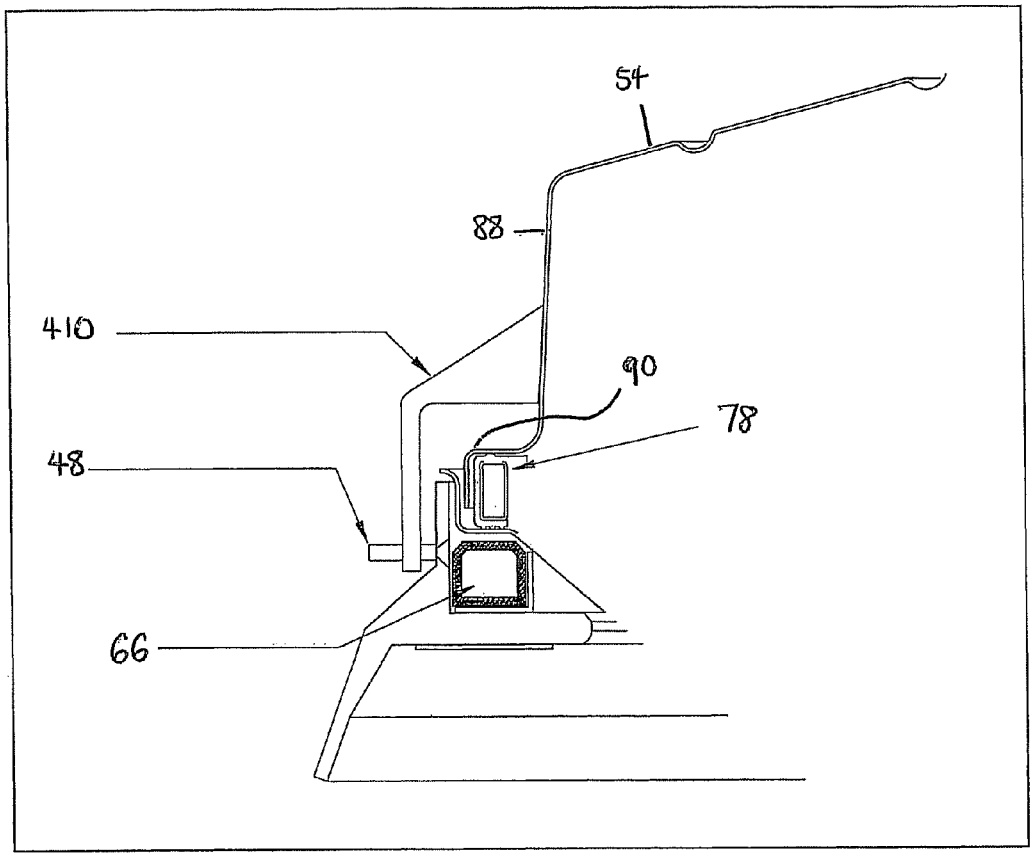
FIG. 20 is a close-up cross-sectional view of the left-hand side of a yet further embodiment with a bracket securing the cover to the chassis of the separator apparatus.

In FIG. 20 there is shown a close-up cross-sectional view of the left-hand side of a yet further embodiment with a bracket securing the lid cover to the chassis of the separator apparatus. In most respects, this embodiment is similar to other previously described embodiments of the invention. Where the same components are used, identical reference numerals have been employed.

The lid cover is secured to the chassis using at least one bracket 410. A bracket 410 is bolted to the cylindrical portion 88 of the cover 18. The bracket also comprises a bayonet hook which engages with a bayonet fitting 48 on the chassis 18. In this arrangement, the shoulder portion 90 of the cover 18, at the lower perimeter of the main cylindrical part 88, bears directly onto the inflatable seal 66. The mesh frame 78 is disposed between the shoulder portion 90 and the inflatable seal 66, such that the bracket 410 acts together with the inflatable seal 66 to secure the mesh frame 78 in place. Preferably, a plurality of brackets are used to provide improved clamping. Other possibilities will be apparent to the skilled person.

The invention claimed is:

1. Screen separating apparatus comprising:

a chassis for supporting a screen frame carrying and stretching a tautly held sieve screen, said chassis providing a first bearing surface;

at least one second bearing surface opposed to said first bearing surface such that the screen frame can be clamped between the first and second bearing surfaces; and at least one expandable element mountable in the chassis to be between said first and second bearing surfaces and expandable in a direction transverse to said bearing surfaces to effect said clamping of the screen frame;

characterised by one or more clamping members the or each of which is movable between a non-deployed position, in which said screen frame carrying said stretched sieve screen can be lifted in said transverse direction away from said first bearing surface for removal from the chassis, and a deployed position, in which the clamping member is located relative to the chassis to provide said second bearing surface or one of a combination of said second bearing surfaces.

2. Apparatus according to claim 1, wherein the second bearing surface or the combination of second bearing surfaces extends over at least half of the circumference of the screen frame.

3. Apparatus according to claim 2, wherein said clamping member comprises a bracket which can be fastened to the chassis.

4. Apparatus according to claim 3, wherein said bracket is of unitary construction.

5. Apparatus according to claim 4, wherein the apparatus includes a plurality of bayonet coupling fitments spaced around the chassis whereby the bracket can be releasably fastened to the chassis.

6. Apparatus according to claim 3, wherein said bracket is a sheath which has an in-turned flange portion arranged to provide said second bearing surface or said combination of second bearing surfaces.

7. Apparatus according to claim 6, wherein the sheath is formed in two parts each of which is pivotable, at one end about a respective hinge axis relative to the chassis to move between a position in which the sheath part embraces a respective part of the chassis and a position in which the sheath part is swung away from said respective part.

8. Apparatus according to claim 7, wherein the two sheath parts are hingedly mounted with the hinges adjacent, and free ends of the sheath parts are each adapted to lie adjacent one another when in their chassis-embracing positions, with a locking device being provided for securing the sheath parts in said chassis-embracing positions.

9. Apparatus according to claim 8, wherein said locking device is magnetic.

10. Apparatus according to claim 6, wherein the sheath comprises a plurality of segments, each pivotable about a respective hinge axis lying in a plane substantially parallel to the plane of the sieve screen, such that each segment can be moved between a first position in which the segment embraces a respective part of the chassis and is circumferentially aligned with adjacent segments, and a second position in which the segment is lowered away from said respective part.

11. Apparatus according to claim 10, wherein said respective hinge axes include an over-centre toggle construction operable to draw the in-turned flange portion of the sheath segment towards said first bearing surface.

12. Apparatus according to claim 6, further comprising a cover to rest on said screen frame and enclose the sieve screen, the cover having a peripheral shoulder portion for engagement by said in-turned flange portion of the sheath.

13. Apparatus according to claim 12, wherein said cover has a skirt portion depending from said shoulder portion to engage said sieve frame.

14. Apparatus according to claim 1 further comprising a removable cover to enclose a product region above the sieve screen, said one or more clamping members being effective when in the clamping position to retain the cover clamped, by expansion of said expandable element, with the screen frame between the first and second bearing surfaces, and being movable when the expandable member is not expanded, from said clamping position to permit removal of said cover.

15. Apparatus according to claim 14, wherein said clamping member comprises a bracket which is bolted to the cover when in the clamping position.

16. Apparatus according to claim 1 comprising a removable cover to enclose a product region above the sieve screen, said cover providing said clamping member and having an extended skirt portion providing a sheath which can be fastened to the chassis and a peripheral flange portion providing said second bearing surface.

17. Apparatus according to claim 1 further comprising a hopper mounted in said chassis to collect fines passing through the sieve screen, said hopper having an annular shelf portion extending between said first and second bearing surfaces to be clamped therebetween together with the screen frame.

18. Apparatus according to claim 1 and including at least one said screen frame.

19. Apparatus according to claim 1 wherein said chassis is adapted to support a circular screen frame.

20. Apparatus according to claim 1 wherein said at least one expandable member comprises an inflatable member.

21. Apparatus according to claim 20, wherein said inflatable member is of bellows construction.

22. Apparatus according to claim 21, wherein said chassis is adapted to support a circular screen frame and said at least one expandable member is of annular shape.

23. Apparatus according to claim 1, wherein said at least one expandable member comprises a piston-and-cylinder arrangement.

24. Apparatus according to claim 23, wherein said piston-and-cylinder arrangement is pneumatically operable.

25. Apparatus according to claim 23, wherein said piston-and-cylinder arrangement is hydraulically operable.

26. Apparatus according to claim 1, wherein said at least one expandable element comprises an annular ring and at least two pneumatic or hydraulic rams operable to drive the ring to effect said clamping.

27. Apparatus according to claim 1 including:

a cover to enclose a space above the sieve screen to contain material to be separated, a hopper to collect fines passing through the sieve screen, at least one inner seal to seal between the cover and the hopper around the circumference of the screen frame when the apparatus is in use, a sheath surrounding said inner seal, at least one outer seal to seal between the sheath and at least one of the cover and the hopper to provide an enclosed volume between the sheath, the cover and the hopper, and an inlet connecting to said enclosed space to enable said enclosed space to be pressurised.

* * * * *